US009126397B2

(12) United States Patent
Hasegawa et al.

(10) Patent No.: US 9,126,397 B2
(45) Date of Patent: Sep. 8, 2015

(54) PRINTING METHOD AND PRINTING DEVICE FOR FABRICS

(71) Applicant: Roland DG Corporation, Hamamatsu-shi, Shizuoka (JP)

(72) Inventors: Hiroaki Hasegawa, Kanazawa (JP); Yutaka Matsuyama, Kanazawa (JP); Koji Yamamura, Kanazawa (JP)

(73) Assignee: Roland DG Corporation, Shizuoka (JP)

( * ) Notice: Subject to any disclaimer, the term of this patent is extended or adjusted under 35 U.S.C. 154(b) by 0 days.

(21) Appl. No.: 14/183,686

(22) Filed: Feb. 19, 2014

(65) Prior Publication Data

US 2014/0230670 A1 Aug. 21, 2014

(30) Foreign Application Priority Data

Feb. 20, 2013 (JP) ..... 2013-031075

(51) Int. Cl.
*B41F 17/00* (2006.01)
*B41J 3/407* (2006.01)
*B41J 15/16* (2006.01)

(52) U.S. Cl.
CPC ..... *B41F 17/003* (2013.01); *B41J 3/4078* (2013.01); *B41J 15/16* (2013.01)

(58) Field of Classification Search
CPC ..... B41F 17/0003; B41F 17/00; B41F 17/38; B41F 17/003
See application file for complete search history.

(56) References Cited

U.S. PATENT DOCUMENTS

| | | | | |
|---|---|---|---|---|
| 5,777,878 | A * | 7/1998 | Helmrich et al. | 700/124 |
| 7,017,486 | B2 * | 3/2006 | Steffen et al. | 101/228 |
| 2003/0052148 | A1 * | 3/2003 | Rajala et al. | 226/44 |
| 2004/0074407 | A1 * | 4/2004 | Iyokawa et al. | 101/228 |
| 2004/0177779 | A1 * | 9/2004 | Steffen et al. | 101/228 |
| 2008/0264995 | A1 * | 10/2008 | Henn et al. | 226/195 |
| 2010/0053251 | A1 | 3/2010 | Igarashi et al. | |
| 2010/0132570 | A1 * | 6/2010 | Suda et al. | 101/217 |
| 2011/0265671 | A1 * | 11/2011 | Brendle | 101/22 |
| 2013/0104760 | A1 * | 5/2013 | Malik et al. | 101/228 |

FOREIGN PATENT DOCUMENTS

| | | | |
|---|---|---|---|
| JP | 2009-090578 | A | 4/2009 |
| JP | 2010-052379 | A | 3/2010 |

* cited by examiner

*Primary Examiner* — David Banh
(74) *Attorney, Agent, or Firm* — Keating & Bennett, LLP

(57) ABSTRACT

A printing method is performed by use of a printing device. The printing device includes a print head, a supply roll, a serving roll, a support roll, a feed roll, and a winding roll. The printing device feeds a fabric material toward the winding roll by a prescribed length each time that a cycle of a print operation is performed by the print head, so that the printing is performed on the fabric material intermittently. The printing method includes performing a first feed operation of intermittently rotating the feed roll by a first motor to pull the fabric material from a print unit and feed the fabric material toward the winding roll by a prescribed length; and performing a second feed operation of intermittingly rotating the serving roll by a second motor to feed the fabric material toward the print unit. A detected tensile force value based on a detected value of the tensile force of the fabric material detected at a position upstream with respect to the print unit is compared to a preset target tensile force, and the second motor is controlled based on a result of the comparison.

10 Claims, 9 Drawing Sheets

PRINTING METHOD AND PRINTING DEVICE FOR FABRICS

The present application claims priority from Japanese Patent Application No. 2013-031075 filed on Feb. 20, 2013, which is incorporated by reference herein in its entirety.

BACKGROUND OF THE INVENTION

1. Field of the Invention

The present invention relates to a printing method and a printing device usable for fabrics.

2. Description of the Related Art

A known printing device usable for fabrics includes a supply roll around which a lengthy fabric material as a printing medium is wound, a support roll for winding therearound the fabric material fed from the supply roll and guiding the fabric material to a print unit, a print head which is located to be above the fabric material in the print unit and is provided for performing printing on the fabric material, and a winding roll which is rotatable when being driven and is provided for winding therearound the fabric material which has passed the print unit. In such a printing device, each time that one cycle of a print operation is performed, the fabric material is fed toward the winding roll by a prescribed length. The printing device performs printing intermittently.

Japanese Laid-Open Patent Publication No. 2010-052379 discloses a printing device for performing printing intermittently on a lengthy fabric material which is fed from the supply roll. The printing device disclosed in this publication includes a flat plate-like support table (platen) for supporting the printing medium. The printing device uses a print head for performing printing on the printing medium supported by the platen. The printing device also includes a pair of conveyance rollers upstream with respect to the platen in a moving direction of the printing medium. The printing device feeds the printing medium toward the platen while holding the printing medium by the pair of conveyance rollers.

The printing medium, which is conveyed while being supported by the platen, is, for example, damaged by being rubbed with the platen. In the case where the printing medium is a fabric material, the letters or the like printed when the printing medium is on the platen, may be blurred.

Japanese Laid-Open Patent Publication No. 2009-090578 proposes a printing device for solving this problem. In the printing device disclosed in this publication, the lengthy printing medium fed from the supply roll is not supported on the flat plate-like platen for performing printing thereon.

This printing device operates as follows. The lengthy printing medium fed from the supply roll is wound around a support roll. The printing medium is guided by the support roll toward a print unit. The printing device includes a guide roll downstream with respect to the support roll in a moving direction of the printing medium. The print unit is provided between the support roll and the guide roll. In the print unit, a print head is located above the printing medium. The print head is used to perform printing on the printing medium.

The printing medium which has passed the print unit is wound around the guide roll and guided by the guide roll toward a winding roll. Then, the printing medium is wound up around the winding roll.

In this printing device, only the winding roll is actively driven. The winding roll is rotated such that the moving distance of the printing medium per unit time is kept constant. The rotation of the winding roll causes the printing medium to be fed from the supply roll. A prescribed rotation resistance is applied to the supply roll, so that a tensile force of the printing medium is kept constant.

For this printing device, paper is mainly assumed as the printing medium. When this printing device is used to perform printing on a fabric material intermittently, the winding roll is rotated intermittently. Such an intermittent rotation of the winding roll causes the fabric material to be wound intermittently by a prescribed length at a position downstream with respect to the print unit.

However, a fabric material is elastic. Therefore, in the case where the printing medium is a fabric material, the length of the fabric material which is fed in the print unit is not kept constant. As a result, the printing may be performed at a position deviated from the position at which the printing is to be performed. For this reason, the printing device described in Japanese Laid-Open Patent Publication No. 2009-090578 cannot perform printing with high precision when the printing medium is a fabric material.

SUMMARY OF THE INVENTION

Preferred embodiments of the present invention provide a printing method and a printing device usable for fabrics that are capable of performing printing with high precision without the printing position being deviated much or significantly.

A printing method according to a preferred embodiment of the present invention is performed by use of a printing device usable for fabrics. The printing device includes a print head that performs printing on a fabric material; a supply roll that the fabric material is to be wound around; a support roll that winds therearound the fabric material fed from the supply roll, the support roll guiding the fabric material toward a position below the print head; a winding roll rotatable by being driven, the winding roll winding up therearound the fabric material which has passed the position below the print head; and a feed roll provided on a moving route of the fabric material between the position below the print head and the winding roll, the feed roll being contactable with the fabric material. The printing device is structured to feed the fabric material toward the winding roll by a prescribed length each time that one cycle of the print operation is performed by the print head, so that the printing is performed on the fabric material intermittently. The printing method includes performing, after one cycle of the print operation, a first feed operation on the fabric material of intermittently rotating the feed roll by a first motor to pull the fabric material from the position below the print head and feed the fabric material toward the winding roll by a prescribed length by the rotation of the feed roll; and performing, along with the first feed operation, a second feed operation on the fabric material of intermittingly rotating a supply/feed roll or the supply roll by a second motor to feed the fabric material toward the position below the print head, the supply/feed roll being contactable with the fabric material at a position upstream with respect to the support roll in a moving direction of the fabric material. A tensile force of the fabric material is detected at a position upstream with respect to the position below the print head in the moving direction of the fabric material; a detected tensile force value based on the detected value of the tensile force of the fabric material is compared to a preset target tensile force value; and the second motor is controlled based on a result of the comparison.

A printing device usable for fabrics according to a preferred embodiment of the present invention includes a print head that performs printing on a fabric material; a supply roll that the fabric material is to be wound around; a support roll that winds therearound the fabric material fed from the supply roll, the support roll guiding the fabric material toward a position below the print head; and a winding roll rotatable by being driven, the winding roll winding up therearound the fabric material which has passed the position below the print head. The printing device is structured to feed the fabric material toward the winding roll by a prescribed length each time that a cycle of the print operation is performed by the print head, so that the printing is performed on the fabric material intermittently. The printing device further includes a feed roll provided on a moving route of the fabric material between the position below the print head and the winding roll, the feed roll being contactable with the fabric material; a first motor that rotates the feed roll; a supply/feed roll acting as the supply roll, or a supply/feed roll different from the supply roll and contactable with the fabric material at a position upstream with respect to the support roll in the moving direction of the fabric material; a second motor that rotates the supply/feed roll; a drive control device that is programmed to perform a first feed operation of controlling the first motor so as to intermittently rotate the feed roll and thus pulling the fabric material from the position below the print head and feeding the fabric material toward the winding roll by a prescribed length, and a second feed operation of controlling the second motor so as to intermittingly rotate the supply/feed roll along with the first feed operation and thus feeding the fabric material toward the position below the print head; and a tensile force detection device that detects a tensile force of the fabric material at a position upstream with respect to the position below the print head in the moving direction of the fabric material. The drive control device includes a memory that stores a target tensile force value of the fabric material; a comparator that compares a detected tensile force value, based on the detected value of the tensile force that is detected by the tensile force detection device, against the target tensile force value stored in the memory and outputs a deviation signal; a drive indicator that receives the deviation signal from the comparator and outputs a drive command signal corresponding to a driving amount of the second motor; and a feed control device that is programmed to control the second motor in accordance with the drive command signal from the drive indicator.

The "supply/feed roll" may be a roll which is different from the supply roll and is provided downstream with respect to the supply roll as in a preferred embodiment described later, or the supply roll itself. In this specification, the terms "upstream" and "downstream" respectively refer to the upstream side and the downstream side in the moving direction of the fabric material. The "feed side" and the "supply/feed roll side" correspond to the upstream side, and the "winding side" and the "winding roll side" correspond to the downstream side. The "tensile force detection device" encompasses a tensile force detection sensor such as a load cell or the like, and also a combination of a member contactable with the fabric material to receive a load in accordance with the tensile force of the fabric material (i.e., the guide roll in a preferred embodiment described later, or the like) and a tensile force detector connected to the member to detect the load (load cell or the like). The "detected tensile force value" may be a detected value itself of the tensile force obtained by the tensile force detection device, or may be, for example, an average value calculated from a plurality of detected values (average tensile force value).

According to a preferred embodiment of the present invention, the feed roll is rotated by the first motor, and thus the fabric material is fed downstream. The rotation amount of the feed roll is controlled, and thus the feed operation on the fabric material is performed at a position below the print head. Along with the feed operation on the fabric material, the supply/feed roll located upstream with respect to the position below the print head is also driven by the second motor. At a position upstream with respect to the position below the print head, the fabric material is actively fed. Therefore, the tensile force of the fabric material is prevented from being changed at the position below the print head due to the fabric material being pulled by the feed roll.

According to a preferred embodiment of the present invention, the tensile force of the fabric material is detected at a position upstream with respect to the position below the print head. The second motor is controlled based on the detected value of the tensile force and the preset target tensile force value. As a result, the change in the tensile force value is significantly reduced or prevented more effectively. Therefore, according to a preferred embodiment of the present invention, even when the printing medium is an elastic material like the fabric material, the expansion and contraction of such an elastic material, which would otherwise be caused by the change in the tensile force, is significantly reduced or prevented. Therefore, printing at a deviated position, which would otherwise be caused due to the change in the tensile force, is prevented, and thus the printing is performed with high precision.

The first feed operation is performed intermittently. There are cases where the active feed of the fabric material by the supply/feed roll does not directly lead to the feed of a portion of the fabric material that is at the position below the print head due to, for example, the frictional resistance between the fabric material and the support roll 4. In such a case, in the initial period of the first feed operation, the tensile force of the portion of the fabric material that is located at the position below the print head may be temporarily increased significantly. In a preferred embodiment according to the present invention, in at least the initial period of the first feed operation, the acceleration set to drive the second motor is preferably set to be larger than the acceleration set to drive the first motor. In another preferred embodiment according to the present invention, the time to start driving the second motor is set to be prior to the time to start driving the first motor. As a result of such an arrangement, in the initial period of the first feed operation, the increase in tensile force of the fabric material is prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

FIG. 1 through FIG. 5 show a printing device usable for fabrics in a preferred embodiment according to the present invention.

Figure 1:
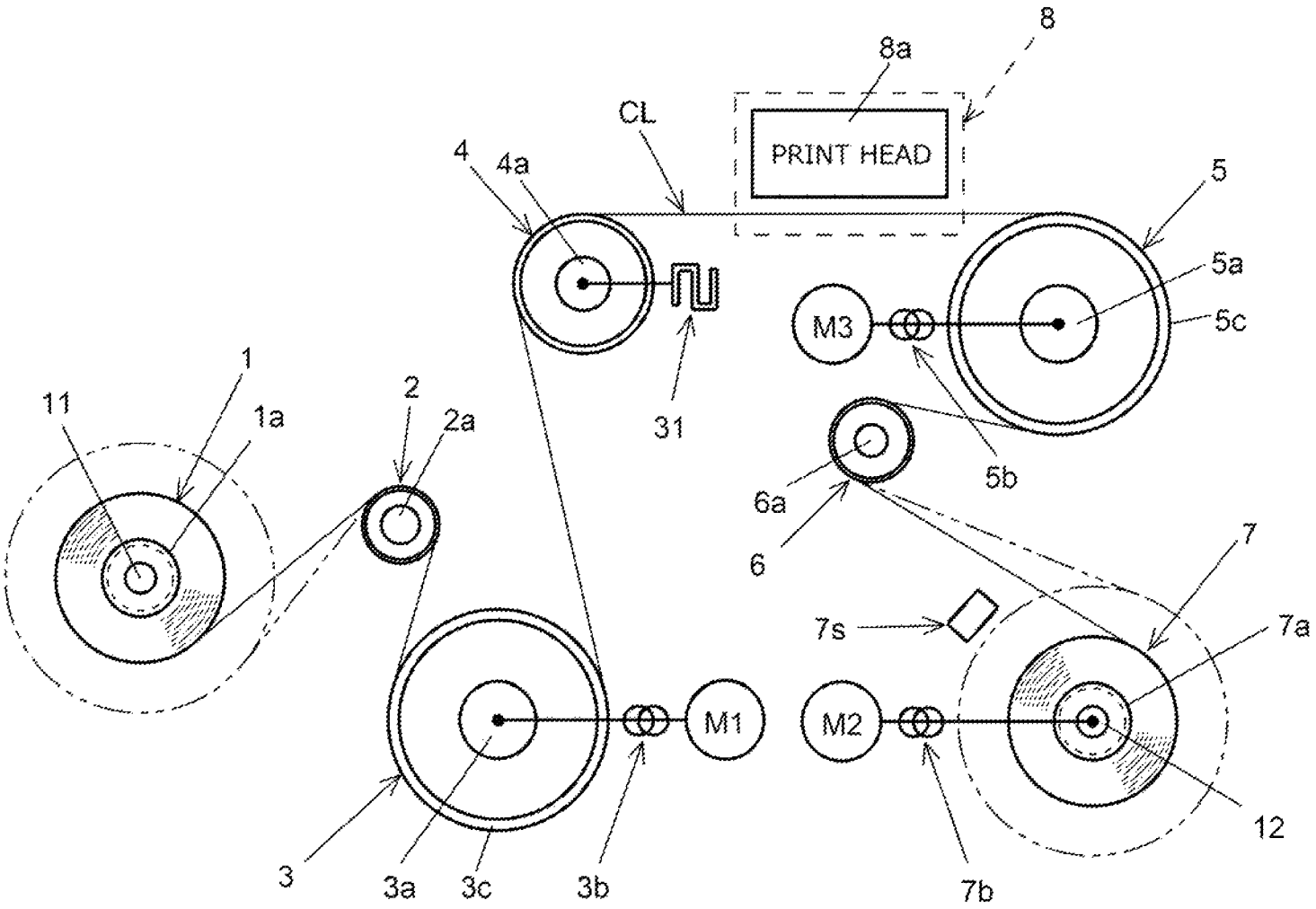
FIG. 1 is a structural view of a printing device according to a preferred embodiment of the present invention.

In the following description, a portion which supplies a fabric material CL toward a print unit 8 will be referred to as a "supply/feed portion". As shown in FIG. 1, in the supply/feed portion, a serving roll 3 is driven by a motor M1 and thus is rotated. The motor M1 preferably is a servo motor in this preferred embodiment, but there is no specific limitation on the type of the motor M1. The motor M1 is an example of a "second motor". The fabric material CL is wound around the serving roll 3. When the motor M1 is rotated, the fabric material CL is fed from a supply roll 1 intermittently.

After passing the print unit 8, the fabric material CL is wound around a feed roll 5. The feed roll 5 is rotated to feed the fabric material CL. Hereinafter, the operation of the feed roll 5 of feeding the fabric material CL will be also referred to simply as a "first feed operation". In the printing device, a tensile force of the fabric material CL is detected. For controlling the motor M1, a driving amount (namely, a rotation amount) of the motor M1 is corrected based on the tensile force value of the fabric material CL.

The feed roll 5 is driven by a motor M3. The motor M3 is an example of a "first motor". The motor M1 and the motor M3 start to be driven at the same time. The acceleration at the time of driving of the motor M1 is set to be larger than the acceleration at the time of driving of the motor M3.

The fabric material CL fed from the serving roll 3 is wound around a support roll 4, and is guided by the support roll 4 toward the print unit 8. The tensile force of the fabric material CL is detected via the support roll 4.

A print head 8*a* is movable in a prescribed direction (i.e., a direction perpendicular to the sheet of FIG. 1). This direction is defined as a "print direction". In the following description, a horizontal direction perpendicular to the print direction, namely, the left-right direction in FIG. 1 is defined as a "front-rear direction". The side of the feed roll 5 with respect to the print unit 8 is defined as the "front side", and the side of the support roll 4 with respect to the print unit 8 is defined as the "rear side".

The printing device in this preferred embodiment includes the supply roll 1 around which the lengthy fabric material CL is wound, the serving roll 3 provided as a supply/feed roll which feeds the fabric material CL toward the print unit 8 (more specifically, toward a position below the print head 8*a*), the support roll 4 which changes the moving direction of the fabric material CL fed from the supply/feed roll 4 so that the fabric material CL is fed toward the print unit 8, the feed roll 5 which moves the fabric material CL by a prescribed length each time that one cycle of a printing operation is performed in the print unit 8, and a winding roll 7 which winds up the fabric material CL which is fed by the feed roll 5 and already has printing performed thereon.

The fabric material CL pulled from the supply roll 1 is wound around the serving roll 3, then is wound around the support roll 4, and is fed toward the print unit 8. After passing the print unit 8, the fabric material CL is wound around the feed roll 5 and is guided toward the winding roll 7.

In such a moving route of the fabric material CL, a portion between the supply roll 1 and the serving roll 3 is provided with a feed-side guide roll 2. The fabric material CL pulled from the supply roll 1 is guided toward the serving roll 3 via the feed-side guide roll 2. In the moving route of the fabric material CL, a portion between the feed roll 5 and the winding roll 7 is provided with a winding-side guide roll 6. The fabric material CL fed by the feed roll 5 is guided toward the winding roll 7 via the winding-side guide roll 6. The guide rolls 2 and 6 are provided so that even when the winding diameters of the supply roll 1 and the winding roll 7 (namely, the diameters of the rolls of the fabric material CL wound around the supply roll 1 and the winding roll 7) are changed, the angle at which the fabric material CL is wound onto the serving roll 3 and the feed roll 5 is not changed. In other words, the guide rolls 2 and 6 are provided in order to keep constant the angle at which the fabric material CL is wound onto the serving roll 3 and the feed roll 5 regardless of the change in the winding diameters of the supply roll 1 and the winding roll 7. (An angle at which the fabric material CL is wound onto the serving roll 3 or the like will be referred to as the "winding angle of the fabric material CL to the serving roll 3" or the like.)

The printing device includes a pair of support frames (not shown in FIG. 1) spaced away from each other in an axial direction of the rolls 1 through 7. The rolls 1 through 7 are each rotatably supported by the support frames at both of two ends thereof. The rolls 1 through 7 are arranged such that the axial directions thereof are parallel or substantially parallel to one another. The axial directions of the rolls 1 through 7 extend horizontally. The support roll 4 and the feed roll 5 are located such that top ends thereof are at the same level as each other. Therefore, the fabric material CL is horizontal between the support roll 4 and the feed roll 5.

The print head 8*a* is provided in the print unit 8 between the support roll 4 and the feed roll 5. The print head 8*a* preferably is a known inkjet print head in this preferred embodiment, but there is no specific limitation on the structure of the print head 8*a*. The print head 8*a* is moved in a width direction of the fabric material CL (in other words, in the print direction), and thus printing is performed on the fabric material CL.

In the print head 8*a*, nozzles (not shown) for color of ink to be used are provided. Each of the nozzles is supplied with ink from an ink cartridge (not shown) of the corresponding color. The print head 8*a* is structured such that ink is ejected from each nozzle by actuation of an inkjet device (not shown).

In this preferred embodiment, the supply roll 1, the feed-side guide roll 2 and the serving roll 3 define the supply/feed portion for the fabric material CL. Hereinafter, the rolls 1 through 3 will be described in detail sequentially.

The supply roll 1 includes a hollow cylindrical core 1*a*. The lengthy fabric material CL is wound around the core 1*a*. The supply roll 1 is located at a level lower than the print unit 8. The supply roll 1 is supported by the pair of support frames mentioned above via a feed shaft 11 inserted into the core 1*a*. The feed shaft 11 is coupled to the core 1*a* by a tapered bush or the like detachable from the feed shaft 11, and is not rotatable with respect to the core 1*a*. The center of the feed shaft 11 and the center of the core 1*a* in a diametrical direction match each other. The core 1*a* is detachable from the feed shaft 11. The feed shaft 11 is longer than the core 1*a* in the axial direction, and both of two ends of the feed shaft 11 protrude from both of two ends of the core 1*a*. The protruding portions at the two ends of the feed shaft 11 (hereinafter, referred to also as "support portions") are rotatably supported by the support frames via bearings or the like. The feed shaft 11 is suspended between the pair of support frames. As a result of this structure, the supply roll 1 is rotatably supported by the pair of support frames via the feed shaft 11.

The support portions of the feed shaft 11 are provided with a braking mechanism (not shown) which supplies a rotation resistance to the feed shaft 11. The braking mechanism includes, for example, a braking member which contacts the feed shaft 11 to supply a frictional resistance to the feed shaft 11, an urging member (spring member or the like) which presses the braking member to the feed shaft 11, and an adjusting member which adjusts the force by which the braking member is pressed to the feed shaft 11 (in the case where, for example, the urging member is a spring member, the adjusting member adjusts the amount of expansion/contraction of the spring member). Therefore, a frictional resistance provided by the braking member acts on the feed shaft 11. The frictional resistance acts as the rotation resistance supplied to the supply roll 1. As a result, the supply roll 1 is prevented from freely rotating. Thus, the fabric material CL is supplied with a resistance when being pulled from the supply roll 1.

The fabric material CL pulled from the supply roll 1 is wound around the feed-side guide roll 2. The feed-side guide roll 2 guides the fabric material CL toward the serving roll 3. A shaft portion 2*a* is provided at each of the two ends of the feed-side guide roll 2 (the shaft portion 2*a* at only one end is shown). The shaft portions 2*a* of the feed-side guide roll 2 are rotatably supported by the pair of support frames via bearings or the like. As described above, the feed-side guide roll 2 is provided to guide the fabric material CL toward the serving roll 3 and keeping constant the winding angle of the fabric material CL to the serving roll 3. In this preferred embodiment, the feed-side guide roll 2 is located such that the axis thereof is at a level higher than the core 1*a* of the supply roll 1 and a top end of the serving roll 3. In order to make the winding angle of the fabric material CL relative to the serving roll 3 large, the feed-side guide roll 2 is located such that the axis thereof is located to the front of a rear end of the serving roll 3. In other words, the axis of the feed-side guide roll 2 is located closer, in the front-rear direction, to the center of the printing device (to the print head 8*a*) than the end of the serving roll 3 on the side of the supply roll 1.

The serving roll 3 is located at a level lower than the print unit 8 and the feed-side guide roll 2. A shaft portion 3*a* is provided at each of the two ends of the serving roll 3 (the shaft portion 3*a* at only one end is shown). The shaft portions 3*a* of the serving roll 3 are rotatably supported by the pair of support frames via bearings or the like. The shaft portion 3*a* at one of the two ends of the serving roll 3 is coupled to the motor M1 via a drive transmission mechanism 3*b* including a gear train or the like.

A sheet-like slip-proof member 3*c* is applied to an outer circumferential surface of the serving roll 3 (in this preferred embodiment, the entirety of the outer circumferential surface of the serving roll 3) in order to prevent the fabric material CL from slipping. As a result, as the serving roll 3 is rotated by the motor M1, the fabric material CL is fed by a length corresponding to the rotation amount of the motor M1 without slipping on the outer circumferential surface of the serving roll 3. The control of the motor M1 will be described later. As can be seen, in this preferred embodiment, the supply/feed portion is structured such that the fabric material CL is fed from the serving roll 3 without being held by a pair of rolls.

The fabric material CL fed from the supply/feed portion is wound around the support roll 4 provided at a level higher than the serving roll 3, and thus the moving direction thereof is changed. The fabric material CL is guided by the support roll 4 toward the print unit 8. After passing the print unit 8, the fabric material CL is wound around the feed roll 5 and guided toward the winding roll 7. At positions upstream and downstream with respect to the print unit 8, the fabric material CL is supported by the support roll 4 and the feed roll 5. As described above, the support roll 4 and the feed roll 5 are located such that the top ends thereof are at the same level as each other. Therefore, the fabric material CL is in a horizontal state in the print unit 8.

A shaft portion 5*a* is provided at each of the two ends of the feed roll 5 (the shaft portion 5*a* at only one end is shown). The shaft portions 5*a* of the feed roll 5 are rotatably supported by the pair of support frames via bearings or the like. The shaft portion 5*a* at one of the two ends of the feed roll 5 is coupled to the motor M3, which is a servo motor, via a drive transmission mechanism 5*b* including a gear train or the like.

A sheet-like slip-proof member 5*c* is also applied to an outer circumferential surface of the feed roll 5 (in this preferred embodiment, the entirety of the outer circumferential surface of the feed roll 5) in order to prevent the fabric material CL from slipping. As a result, as the feed roll 5 is rotated by the motor M3, the fabric material CL is fed by a length corresponding to the rotation amount of the motor M3 without slipping on the outer circumferential surface of the feed roll 5. The control on the motor M3 will be described later. As can be seen, in this preferred embodiment, the fabric material CL already having printing performed thereon is fed from the feed roll 5 toward a winding portion without being held by a pair of rolls.

Now, the roles of the feed roll 5 and the serving roll 3 will be described. In the print unit 8, the fabric material CL is fed solely by the rotation of the feed roll 5. The serving roll 3 has a role of actively pulling the fabric material CL from the supply roll 1 in accordance with the operation of the feed roll 5 of feeding the fabric material CL. The serving roll 3 has a role of actively feeding the fabric material CL to the print unit 8. The feed operation on the fabric material CL in the print unit 8 can be performed even in a printing device as described as a conventional device (Japanese Laid-Open Patent Publication No. 2009-090578) which does not include a driver in a feed portion. Specifically, the feed operation on the fabric material CL can be performed even when the fabric material CL is fed from the feed side merely passively. The feed operation on the fabric material CL can be realized only by driving the feed roll 5. Therefore, the feed operation on the fabric material CL is performed solely by the feed roll 5. Preferably, only the feed roll 5 has the role of feeding the fabric material CL. However, in this preferred embodiment, the elasticity of the fabric material CL is considered. Therefore, the printing device in this preferred embodiment actively drives and rotates the serving roll 3 in order to control the moving distance of the fabric material CL in the print unit 8.

The tensile force of the fabric material CL is detected via the support roll 4. The fabric material CL is wound around the support roll 4 at a position close to, and upstream with respect to, the print unit 8. In this preferred embodiment, the support roll 4 has a function of guiding the fabric material CL horizontally toward the print unit 8 and also acts as a part of a tensile force detection device. FIGS. 2*a*, 2*b*, 3*a*, and 3*b* show a structure of supporting both of the two ends of the supply roll 4.

Figure 2A:
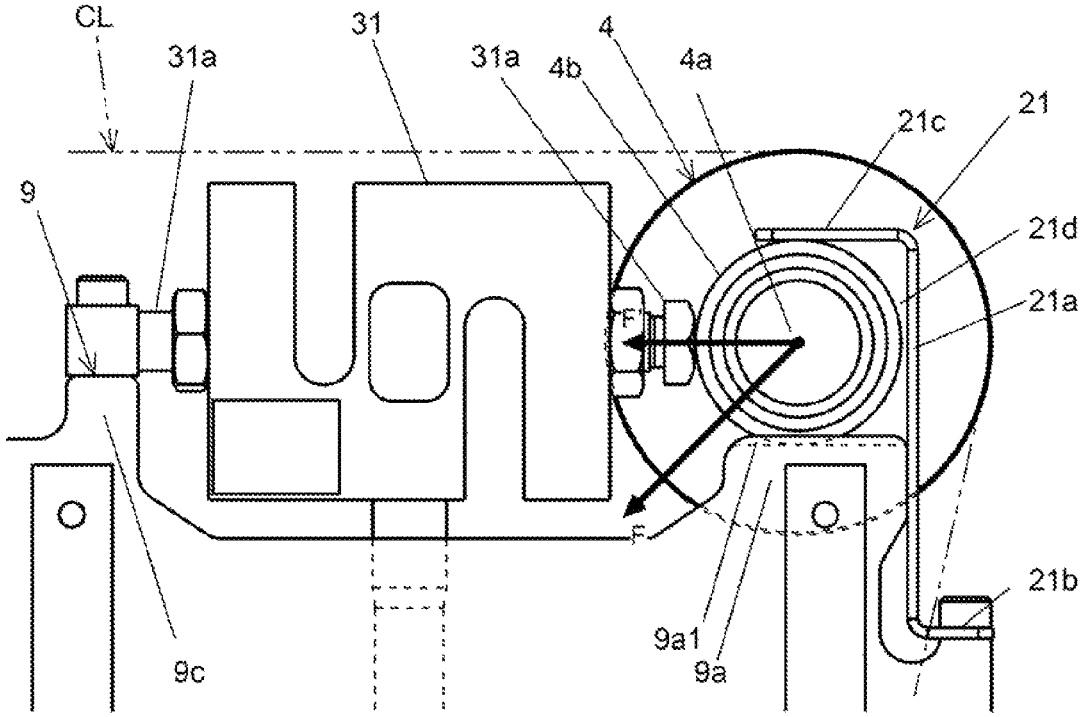
FIG. 2*a* is a side view showing a support structure at one of two ends of a support roll.
Figure 3A:
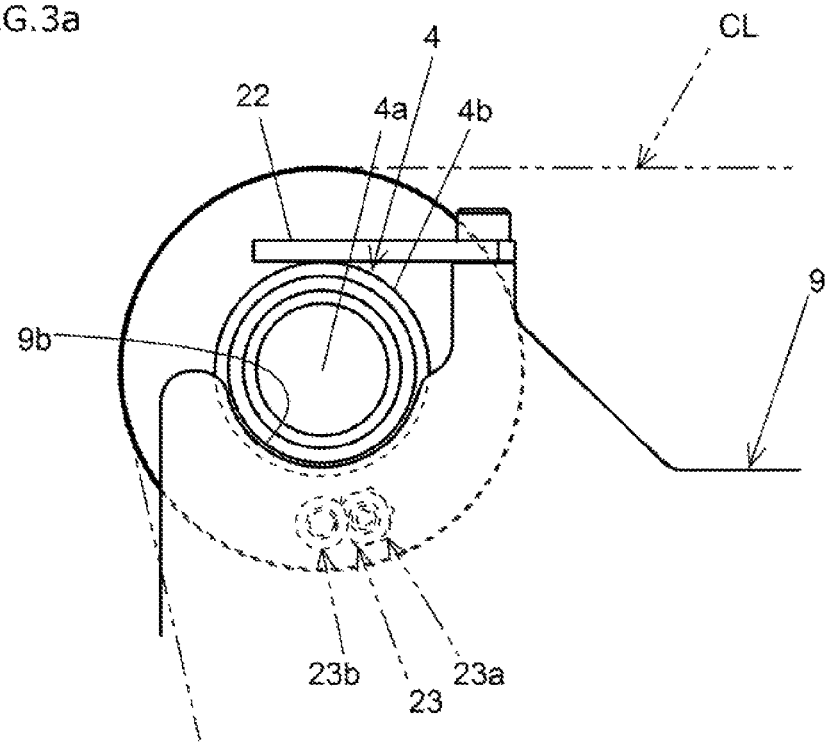
FIG. 3*a* is a side view showing a support structure at the other end of the support roll.

A shaft portion 4*a* is provided at each of the two ends of the support roll 4, and bearings 4*b* are fit to the shaft portions 4*a*. More specifically, the bearings 4*b* are fit to outer circumferential surfaces of the shaft portions 4*a*. The bearings 4*b* are put on top surfaces of the pair of support frames (only one is shown in FIG. 2*a* and FIG. 3*a* represented with reference sign 9). The shaft portions 4*a* are supported by the pair of support frames 9 via the bearings 4*b*. One of the two ends of the support roll 4 is connected to a load detector (load cell) 31 which detects a load in accordance with the tensile force of the fabric material CL. At this end of the support roll 4, the tensile force of the fabric material CL is detected.

Figure 2B:
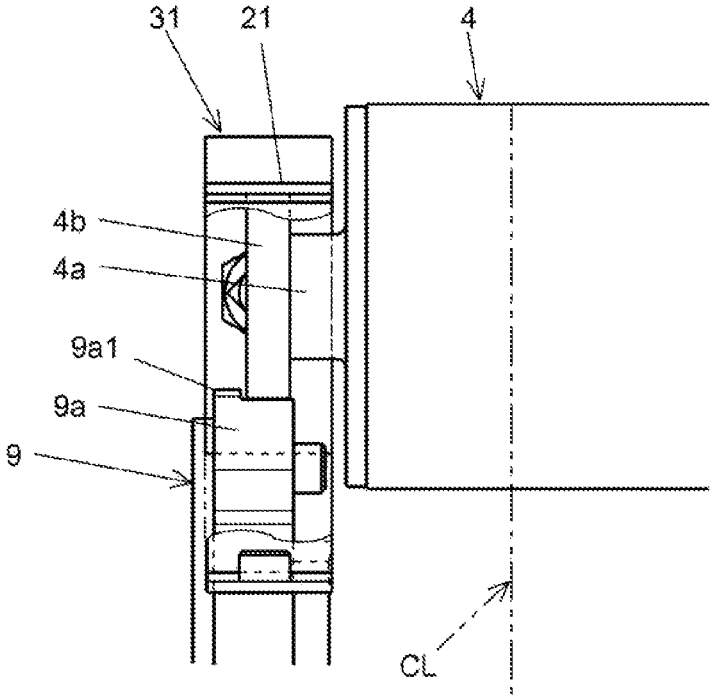
FIG. 2*b* is a front view thereof.

As shown in FIGS. 2*a* and 2*b*, the support frame 9 provided at one end of the support roll 4 includes a first protrusion 9*a* protruding upward. The first protrusion 9*a* is formed at a position corresponding to the one end of the support roll 4. The bearing 4*b* fit to the shaft portion 4*a* at the one end of the support roll 4 (hereinafter, referred to as the "one bearing 4*b*") is put on, and supported by, the first protrusion 9*a*. A top surface of the first protrusion 9*a* is horizontal. The first protrusion 9*a* has approximately the same length as the diameter of the one bearing 4*b* in the front-rear direction. The one end of the support roll 4 is supported so as to be displaceable in the horizontal direction.

The top surface of the first protrusion 9*a* has a step 9*a*1 protruding upward. The step 9*a*1 is located at a position, on the top surface of the first protrusion 9*a*, outside of the one bearing 4*b* in the axial direction (namely, located at a position spaced away from the support roll 4 in the axial direction). The step 9*a*1 restricts the one bearing 4*b* from being displaced outward. In this preferred embodiment, a first restriction member 21 is provided to restrict the one bearing 4*b* from being displaced in an up-down direction.

The first restriction member 21 includes a support portion 21*a*, a fixed portion 21*b* and a restriction portion 21*c*. The support portion 21*a* has the same or substantially the same length as that of the support frame 9 in the axial direction and extends in the up-down direction. The fixed portion 21*b* extends rearward from a bottom end of the support portion 21*a*. The restriction portion 21*c* extends forward from a top end of the support portion 21*a*. The support portion 21*a*, the fixed portion 21*b* and the restriction portion 21*c* are preferably integral with each other. The first restriction member 2*l* is structured such that the fixed portion 21*b* is fixed to a top surface of the support frame 9 and a bottom surface of the restriction portion 21*c* contacts a top end of the one bearing 4*b*. The support portion 21*a* contacts a rear end surface of the first protrusion 9*a* of the support frame 9. In the state where the one bearing 4*b* is connected to the load cell 31, a gap 21*d* is present between a front surface of the support portion 21*a* and the one bearing 4*b*.

Figure 3B:
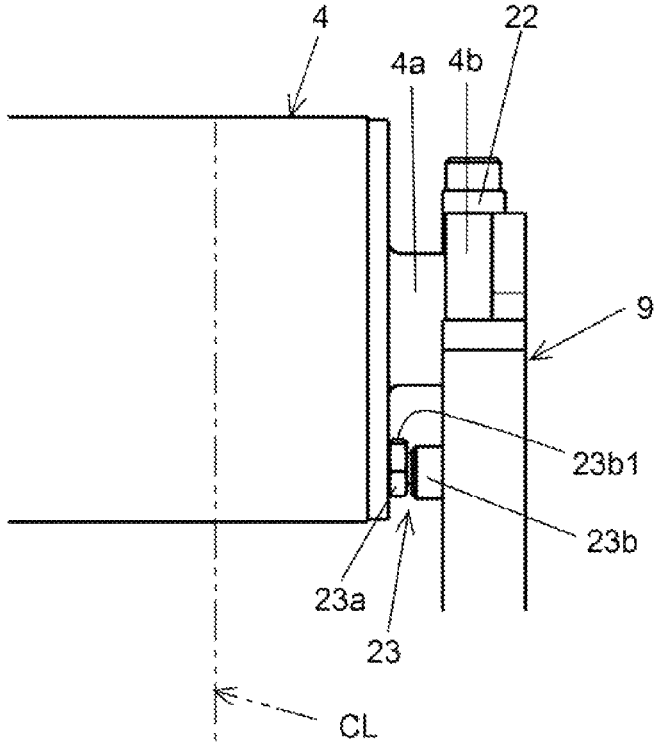
FIG. 3*b* is a front view thereof.

As shown in FIGS. 3*a* and 3*b*, the support frame 9 provided at the other end of the support roll 4 includes a receiving portion 9*b* which is recessed in an arc shape. The receiving portion 9*b* is located at a position corresponding to the other end of the support roll 4. The receiving portion 9*b* is arranged so as to receive the bearing 4*b* fit to the shaft portion 4*a* provided at the other end of the support roll 4 (hereinafter, referred to as the "other bearing 4*b*". The other bearing 4*b* is received by, and supported by, the receiving portion 9*a*. The support frame 9 includes a plate-shaped second restriction member 22. The second restriction member 22 extends rearward from a portion of the support frame 9 that is to the front of the receiving portion 9. The second restriction member 22 is structured to contact a top end of the other bearing 4*b* received by the receiving portion 9*b*. As a result of this structure, the other end of the support roll 4 is supported by the support frame 9 so as not to be displaced in the front-rear direction or in the up-down direction.

As shown in FIGS. 2*a* and 2*b*, the load cell 31 is connected to the one end of the support roll 4. In this preferred embodiment, the load cell 31 preferably is S-shaped. A shaft portion 31*a* is fixed to each of two ends of the load cell 31. One of the shaft portions 31*a* is supported by the support frame 9, and the other shaft portion 31*a* is contactable with the one bearing 4*b*. The support frame 9 provided at the one end of the support frame 9 includes a second protrusion 9*c* protruding upward. The second protrusion 9*c* is located at a position corresponding to the other end of the supply roll 4. The second protrusion 9*c* is located to the front of the first protrusion 9*a*. The shaft portion 31*a* at one of the two ends of the load cell 31 is fixed to the second protrusion 9*c*. The load cell 31 is supported by the support frame 9 in a cantilever state.

The load cell 31 is supported horizontally. The axis of each of the shaft portions 31*a* of the load cell 31 is at the same or substantially the same level as that of the axis of the one bearing 4*b* located on the support frame 9 horizontally. The support roll 4 supported by the support frames 9 so as to be displaceable in the horizontal direction is urged forward by the tensile force of the fabric material CL. The force by which the support roll 4 is urged is received by the other shaft portion 31*a* of the load cell 31. As a result, the load acting on the support roll 4 in accordance with the tensile force of the fabric material CL is detected by the load cell 31.

In this preferred embodiment, an obliquely downward force represented with arrow F in FIG. 2*a* acts on the support roll 4 by the tensile force of the fabric material CL. A load F', which is a horizontal component of the force F, acts on the load cell 31. The load cell 31 detects the load F' and outputs an electric signal (load detection signal) in accordance with the load F' to a drive controller 43 described later.

As shown in FIGS. 3*a* and 3*b*, at the other end of the support roll 4, a rotation inhibition mechanism 23 which inhibits the support roll 4 from rotating in the moving direction of the fabric material CL is provided. The rotation inhibition mechanism 23 is provided for the purpose of preventing the fabric material CL in the print unit 8 from moving upward or downward along with the rotation of the support roll 4. In order to perform printing with high precision, the level of the fabric material CL needs to be kept constant as much as possible in the print unit 8. Even if the support roll 4 has a very high out-of-roundness, the position of a top end of the support roll 4 may be changed along with the rotation of the support roll 4 due to a slight dimension error and/or a slight assembly error of an end portion of the support roll 4 or other elements. Therefore, it is basically preferable that the support roll 4 is not rotated. This is why the rotation inhibition mechanism 23 is provided.

In this preferred embodiment, the rotation inhibition mechanism 23 preferably includes a nut 23*a* attached to an end surface at the other end of the support roll 4 and a screw member 23*b* screwed into an inner side surface of the support frame 9. The nut 23*a* and a head 23*b*1 of the screw member 23*b* are engaged with each other to inhibit the rotation of the support roll 4.

In the end surface at the other end of the support roll 4, a female screw hole (not shown) is provided. The female screw hole is located at a position spaced away from the axis of the support roll 4. A hexagon socket set screw (not shown) is screwed into the female screw hole. The nut 23*a* is screwed into the hexagon socket set screw. In this manner, the nut 23*a* is attached to the end surface at the other end of the support roll 4. In the inner side surface of the support frame 9 that faces the end surface of the support roll 4, a female screw hole (not shown) is provided. As seen in the axial direction of the support roll 4, the distance between the female screw hole in the inner side surface of the support frame 9 and the axis of the support roll 4 is the same as the distance between the female screw hole provided in the end surface of the support roll 4 and the axis of the support roll 4. The screw member 23*b* is screwed into the female screw hole provided in the inner side surface of the support frame 9, and the head 23*b*1 of the screw member 23*b* protrudes from the inner side surface of the support frame 9.

In the state where the nut 23*a* and the screw member 23*b* are not engaged with each other, the support roll 4 is rotatable. When the support roll 4 rotates in one direction along with the movement of the fabric material CL, the nut 23*a* and the screw member 23*b* are put into engagement with each other. As a result, the support roll 4 is prevented from rotating further in the one direction. As can be seen, in this preferred embodiment, the support roll 4 is rotatably supported via the bearing 4*b*, and also the rotation inhibition mechanism 23 which inhibits the rotation of the support roll 4 is provided. Such a structure is provided in order to allow the support roll 4 to be rotatable when, for example, a certain type of fabric material CL is used as the printing medium.

In the case where a guide member which changes the moving direction of the fabric material CL toward the print unit 8 (in this preferred embodiment, the support roll 4 is such a guide member) is a non-rotatable roll or a non-roll-type member, the frictional resistance between the guide member and the fabric material CL may be high depending on the type of the fabric material CL. In this case, the length of the fabric material CL fed from the serving roll 3 does not match the length of the fabric material CL fed to the print unit 8. This may result in a situation where the fabric material CL does not have an appropriate tensile force in the print unit 8. An inappropriate tensile force has an adverse effect on printing. The effect caused by an inappropriate tensile force is more serious than the effect caused by the up-down movement of the fabric material CL along with the rotation of the support roll 4. Therefore, when the tensile force of the fabric material CL cannot be appropriate, it is preferable to allow the support roll 4 to rotate. For this reason, in this preferred embodiment, the rotation inhibition mechanism 23 is arranged such that the support roll 4 can be switched between a rotatable state and a non-rotatable state. More specifically, when the support roll 4 is to be rotatable, the nut 23*a* and the hexagon socket set screw attached to the support roll 4 are removed, or the screw member 23*b* attached to the support frame 9 is removed.

The rotation inhibition mechanism 23 is not limited to having the above-described structure. For example, the combination of the hexagon socket set screw and the nut 23*a* may be replaced with a single screw member. Alternatively, for example, the support frame 9 and the support roll 4 may be coupled to each other by a coupling tool such as a belt or the like, or a screw member inserted into a through-hole provided in the support frame 9 may be inserted into the support roll 4.

Referring to FIG. 1, the fabric material CL fed from the support roll 4 to the feed roll 5 and already having printing performed thereon is guided to the winding roll 7 via the winding-side guide roll 6.

The fabric material CL fed from the feed roll 5 is wound around the winding-side guide roll 6. The winding-side guide roll 6 guides the fabric material CL toward the winding roll 7. A shaft portion 6*a* is provided at each of the two ends of the winding-side guide roll 6 (the shaft portion 6*a* at only one end is shown). The shaft portions 6*a* of the winding-side guide roll 6 are supported by the pair of support frames 9 via bearings or the like. As described above, the winding-side guide roll 6 is provided to guide the fabric material CL toward the winding roll 7 and keeping constant the winding angle of the fabric material CL to the winding roll 7. In this preferred embodiment, the winding-side guide roll 6 is located at a level higher than the winding roll 7. The axis of the winding-side guide roll 6 is located at a level lower than the axis of the feed roll 5. The winding-side guide roll 6 is located to the rear of the feed roll 5 and the winding roll 7 (closer to the support roll 4). In order to make the winding angle of the fabric material CL relative to the feed roll 5 large, the winding-side guide roll 6 is located such that a top end thereof is at a level higher than a bottom end of the feed roll 5 and the level of the axis of the winding-side guide roll 6 is close to the level of the bottom end of the feed roll 5.

The winding roll 7 is located at a level lower than the feed roll 5. The winding roll 7 is rotatably supported by the pair of support frames 9. The winding roll 7 includes a hollow cylindrical core 7*a* and a winding shaft 12 which supports the core 7*a*. The lengthy fabric material CL already having printing performed thereon is wound around an outer circumferential surface of the core 7*a*. The winding shaft 12 is inserted into the core 7*a*. The winding shaft 12 is coupled to the core 7*a* by a tapered bush or the like detachable from the winding shaft 12, and is not rotatable with respect to the core 7*a*. The center of the winding shaft 12 and the center of the core 7*a* in a diametrical direction match each other. The winding shaft 12 is longer than the core 7*a* in the axial direction, and both of two ends of the winding shaft 12 protrude from both of two ends of the core 7*a*. The protruding portions at the two ends of the winding shaft 12 (hereinafter, referred to also as "support portions") are rotatably supported by the support frames 9 via bearings (not shown) or the like. The winding shaft 12 is suspended between the pair of support frames 9. As a result of this structure, the winding roll 7 is rotatably supported by the pair of support frames 9 via the winding shaft 12. The core 7*a* is detachable from the winding shaft 12 in the state where the entirety of the fabric material CL is wound therearound.

A motor M2 is coupled to one of the two ends of the winding shaft 12 via a drive transmission mechanism 7*b* including a gear train or the like. The motor M2 is a torque motor, and the torque thereof is controlled such that the winding tensile force is kept constant. A winding diameter sensor 7*s* is provided in the vicinity of the winding roll 7. The winding diameter of the winding roll 7 is detected by the winding diameter sensor 7*s*. The torque of the motor M2 is adjusted in accordance with the winding diameter of the winding roll 7 that is specified based on a signal from the winding diameter sensor 7*s*. As can be seen, in this preferred embodiment, the winding portion is structured to wind up the fabric material CL fed from the feed roll 5 at a prescribed tensile force. As a result, the fabric material CL is prevented from being wrinkled when being wound up by the winding roll 7.

Figure 4:
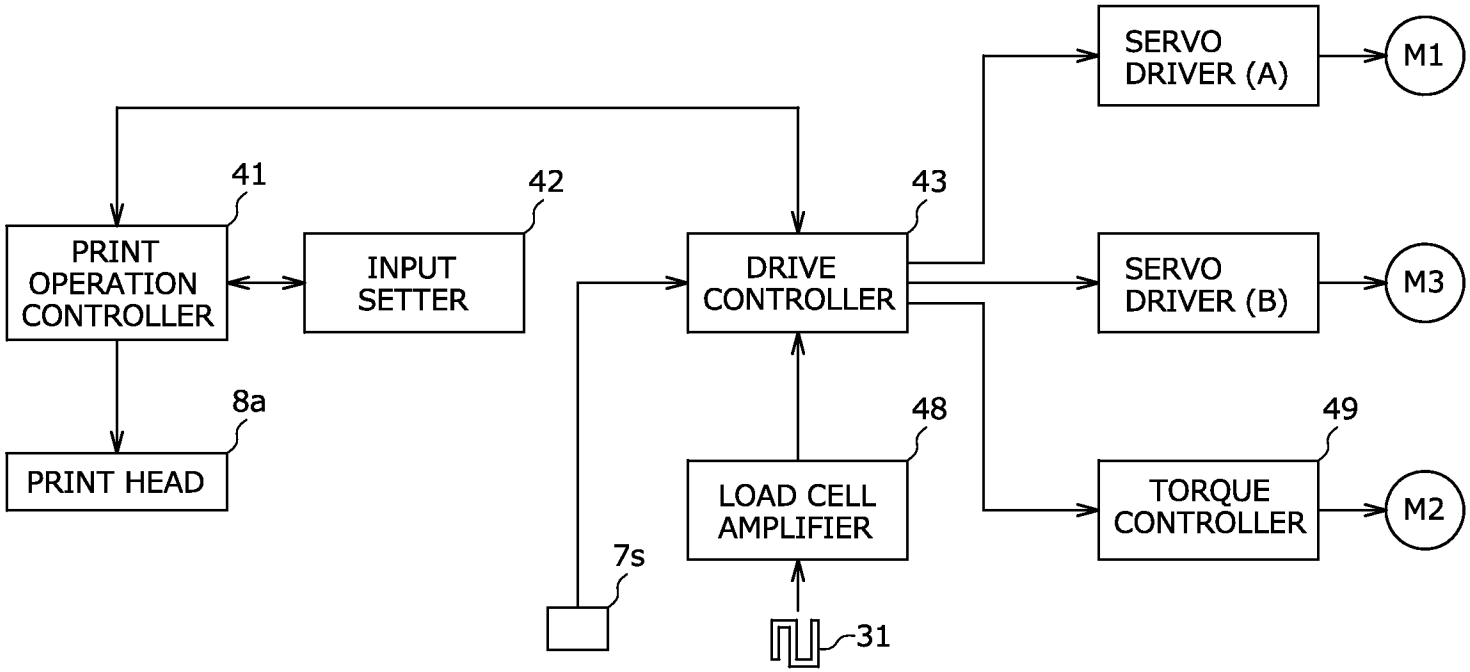
FIG. 4 is a control block diagram of the printing device.
Figure 5:
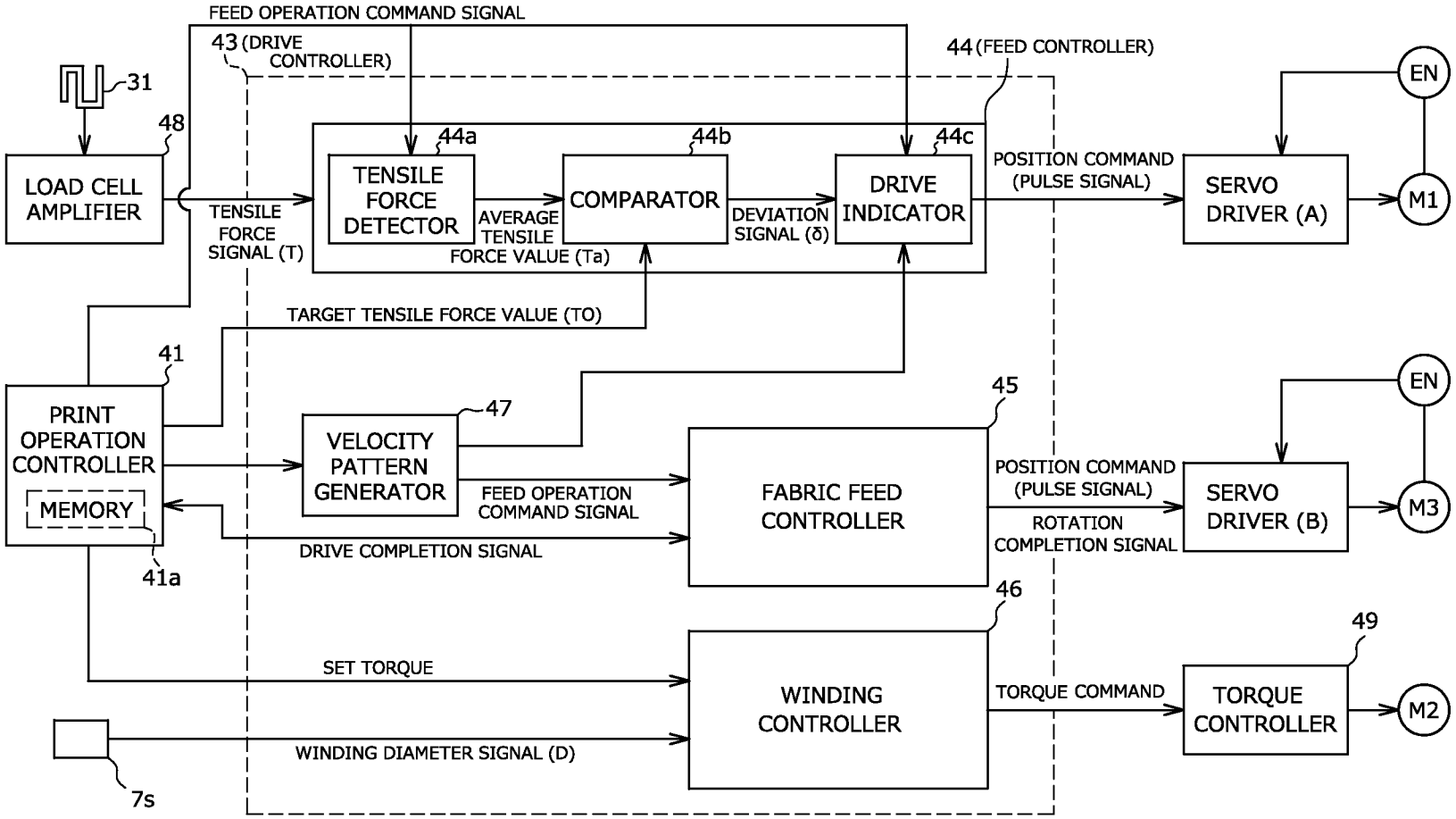
FIG. 5 is a control block diagram of a portion of the printing device.

FIG. 4 shows a structure of a controller of the printing device in this preferred embodiment. FIG. 5 shows a portion of the elements shown in FIG. 4 in more detail. The controller in this preferred embodiment includes a print operation controller 41 which is programmed to control the operation of the print head 8*a*, and a drive controller 43 which is programmed to control the driving of the motors. An input setter 42 is provided to input or setting a set value of a target tensile force of the fabric material CL, a set value of the rotation amount of each of the motor M1 and the motor M3 in the feed operation, a set value of the torque to perform torque control on the motor M2, and the like. The input setter 42 is connected to the print operation controller 41. The set values which are input or set by the input setter 42 are stored in a memory 41*a* built in the print operation controller 41. A command signal or the like in accordance with each set value is transmitted to the drive controller 43.

The operation of the printing device is performed in the procedure described below.

In the state where the fabric material CL is at a pause, the print head 8*a* follows a command from the print operation controller 41 to perform printing on a prescribed printing range in the front-rear direction of the fabric material CL while moving in the width direction of the fabric material CL.

After the print head 8*a* completes one cycle of print operation, the motor M3 is driven and the feed roll 5 is rotated by a command from the print operation controller 41. As a result, the first feed operation on the fabric material CL is performed. At the same time, the motor M1 is driven, and the serving roll 3 performs the second feed operation to feed the fabric material CL toward the print unit 8.

After the first feed operation on the fabric material CL is completed, the print operation of 1) is repeated. A series of these operations is repeated.

For each cycle of print operation, the print operation controller 41 moves the print head 8*a* in the width direction of the fabric material CL and has ink ejected from the plurality of nozzles provided in the print head 8*a*. Namely, the print operation controller 41 has the print head 8*a* perform desired printing. In order to perform the above-described procedure in repetition, the print operation controller 41 outputs an operation command signal to command a feed operation on the fabric material CL to the drive controller 43 at the time that one cycle of a print operation is completed. Also at the time that the feed operation on the fabric material CL is completed, the print operation controller 41 receives a driving completion signal, indicating that the feed operation is completed, from the drive controller 43 and has the print head 8*a* perform printing again.

The printing can be performed by one-way printing or two-way printing. The print head 8*a* can make an outward movement of moving from a position at one end in the width direction of the fabric material CL (this position will be referred to also as the "wait position") to a position at the other end (namely, a position on the opposite side from the wait position in the width direction of the fabric material CL), and a return movement of moving from the position at the other end to the wait position. In one-way printing, the print head 8*a* performs printing only during the outward movement but does not perform printing during the return movement. In the two-way printing, the print head 8*a* performs printing during both of the outward movement and the return movement. In the two-way printing, one cycle of print operation includes the outward movement and the return movement. In the one-way printing, a feed operation command signal can be output at the time when the print head 8*a* reaches the other end of the fabric material CL, and the feed operation on the fabric material CL (namely, the rotation of the feed roll 5) can be started during the return movement of the print head 8*a* to the wait position. By contrast, in the two-way printing, a feed operation command signal is output at the time when the print head 8*a* returns to the wait position.

As described above, the print operation controller 41 includes the memory 41*a*. Set values and the like described herein which are input or set by the input setter 42 are stored in the memory 41*a* and may include the values and amounts described below.

Set value of the target tensile force of the fabric material CL (target tensile force value).

Rotation amount of the motor M3 required for one cycle of first feed operation (set rotation amount), and rotation amount of the motor M1 required for one cycle of second feed operation (set rotation amount). The rotation amount of the motor M3 required for one cycle of first feed operation is an amount in accordance with the rotation amount of the feed roll 5 made in one cycle of first feed operation. The rotation amount of the feed roll 5 made in one cycle of first feed operation corresponds to the moving distance of the fabric material CL during one cycle of first feed operation. The rotation amount of the motor M1 required for one cycle of second feed operation is an amount in accordance with the rotation amount of the serving roll 3 made in one cycle of second feed operation. Where the expansion or contraction of the fabric material CL is not considered, the length of the fabric material CL fed by the serving roll 3 needs to match the moving distance of the fabric material CL in the print unit 8 (namely, the length of the fabric material CL fed by the feed roll 5). In this preferred embodiment, the diameter of the feed roll 5 preferably is equal or substantially equal to the diameter of the serving roll 3. Therefore, the set rotation amount of the motor M1 preferably is equal or substantially equal to the set rotation amount of the motor M3.

Acceleration during an acceleration period of each of the motor M1 and the motor M3, and deceleration during a deceleration period of each of the motor M1 and the motor M3. In this preferred embodiment, the acceleration is kept constant throughout the acceleration period, and the deceleration is kept constant throughout the deceleration period. Therefore, one value is set as each of the acceleration and the deceleration. The acceleration of the motor M3 is different from the acceleration of the motor M1. The acceleration of the motor M1 is set to be larger than the acceleration of the motor M3.

Operation period of each of the motor M3 and the motor M1; namely, the time period in which each of one cycle of first feed operation and one cycle of second feed operation is performed.

Set torque value to perform torque control on the motor M2.

As shown in FIG. 5, the drive controller 43 includes a feed controller 44 which generates a drive command to the motor M1, a fabric feed controller 45 which generates a drive command to the motor M3, and a winding controller 46 which generates a torque command to the motor M2. The drive controller 43 also includes a velocity pattern generator 47. The velocity pattern generator 47 creates velocity patterns for the motor M1 and the motor M3 based on the set values and the like stored in the memory 41*a* of the print operation controller 41 and outputs the velocity patterns to the feed controller 44 and the fabric feed controller 45.

This will be described in more detail. The velocity pattern controller 47 creates a velocity pattern for each of the motor M1 and the motor M3 based on the rotation amount (see item 2) above) of each of the motor M1 and the motor M3, the acceleration and the deceleration of each of the motor M1 and the motor M3 (see item 3) above), and the operation period of each of the motor M1 and the motor M3 (see item 4) above) which are stored in memory 41*a* of the print operation controller 41. When such set values are input or set by the input setter 42, the print operation controller 41 outputs a setting signal representing the set values to the velocity pattern generator 47. The velocity pattern generator 47 outputs each of the created velocity patterns to the feed controller 44 or the fabric feed controller 45.

Figure 6:
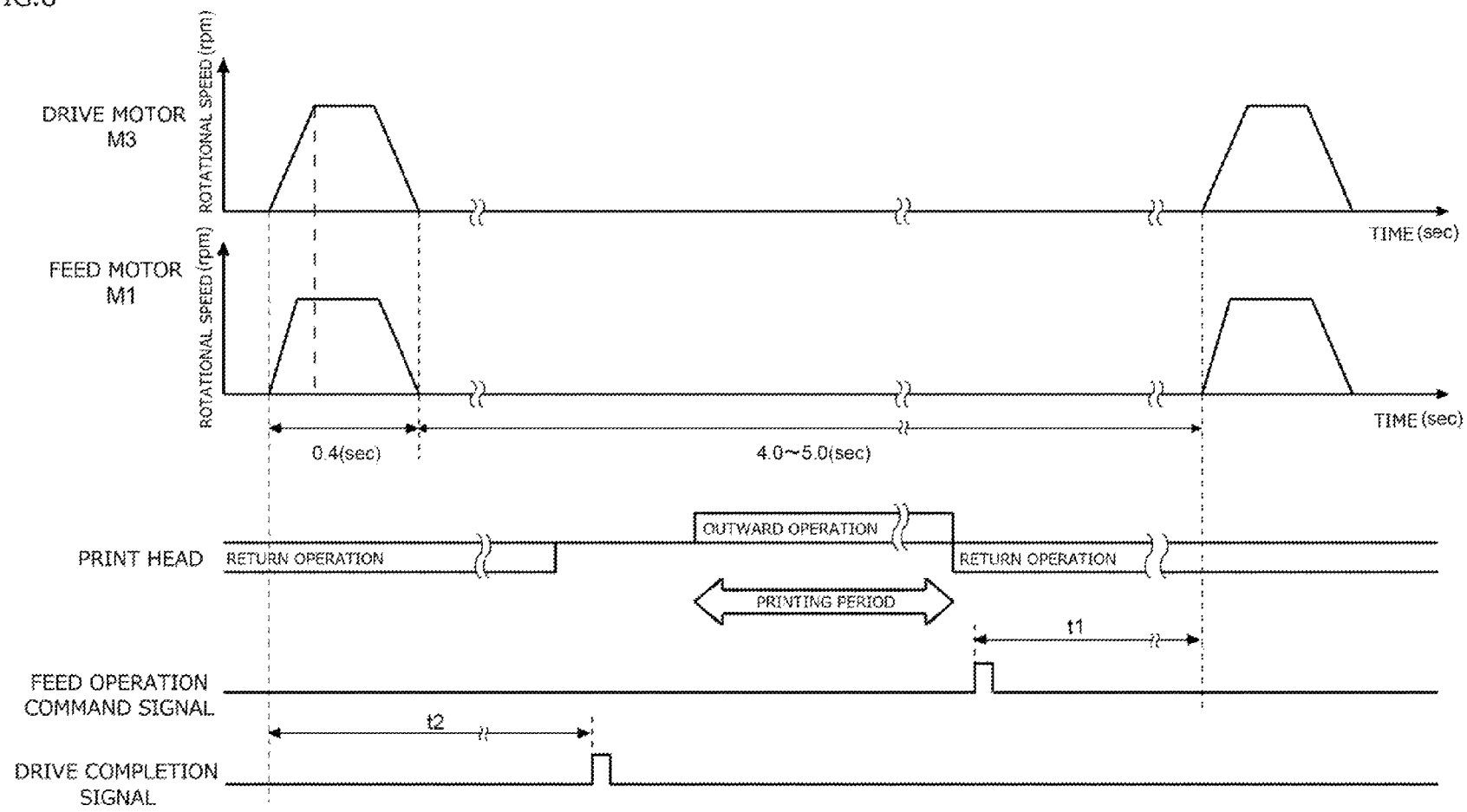
FIG. 6 is a timing chart showing an operation of each of a print head, a print operation controller and a fabric feed controller.
Figure 7A:
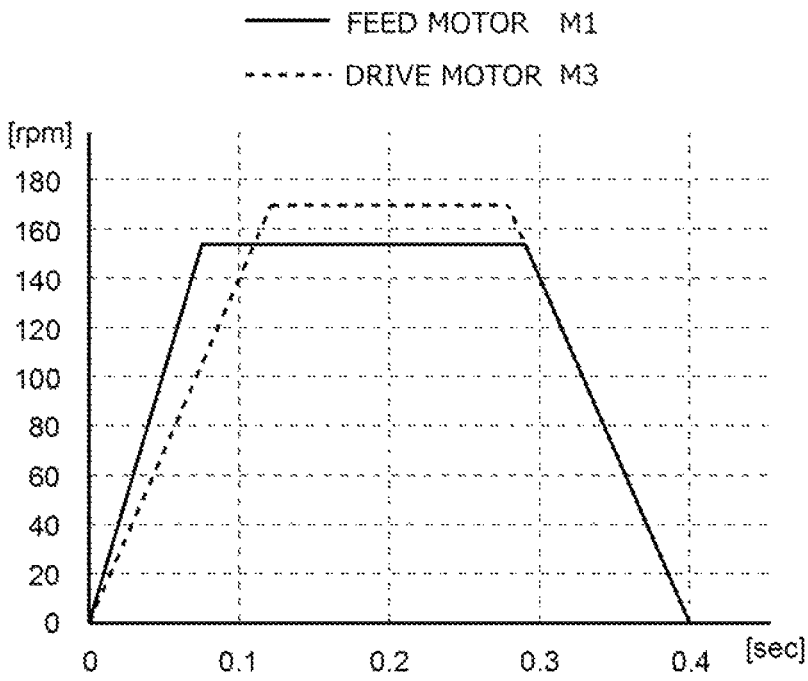
FIG. 7*a* is a graph showing an example of velocity pattern created by a velocity pattern generator.

The timing chart shown in FIG. 6 shows an operation performed by the print head 8*a*, the print operation controller 41 and the fabric feed controller 45 for one example of velocity pattern. FIG. 7*a* shows one example of the velocity pattern in detail. In this preferred embodiment, velocity patterns are each as follows. First, in the acceleration period from the start of the rotation, the velocity increases linearly at uniform acceleration. A constant velocity drive period follows the acceleration period. In the deceleration period after the constant velocity drive period, the velocity decreases linearly at uniform deceleration. As described above, in this preferred embodiment, the acceleration of the motor M1 is set to be larger than the acceleration of the motor M3. Therefore, as shown in FIG. 7*a*, the degree of increase of the rotation speed in the acceleration period is larger for the motor M1 than for the motor M3 (in other words, the gradient of the straight line in the acceleration period is more steep for the motor M1 than for the motor M3).

Figure 7B:
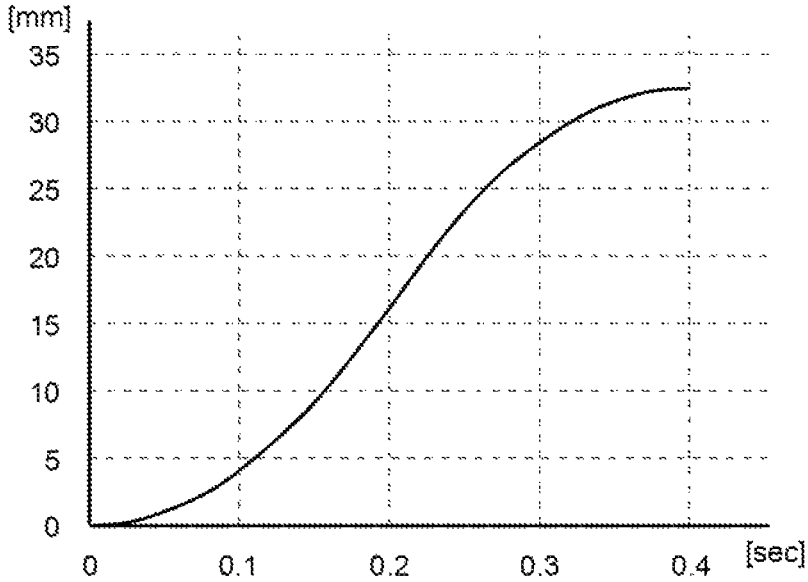
FIG. 7*b* is a graph showing a moving distance of a fabric material based on the example of velocity pattern.

In this preferred embodiment, the velocity pattern is set such that the roll is rotated by the set rotation amount during the set operation time (in the example shown in FIGS. 7*a* and 7*b*, about 0.4 seconds). The area sizes of the trapezoids represented by the velocity patterns correspond to the rotation amounts of the motor M1 and the motor M3. Since the set rotation amounts of the motor M1 and the motor M3 are the same as each other, the area size of the trapezoid represented by the velocity pattern for the motor M1 is the same as the area size of the trapezoid represented by the velocity pattern for the motor M3. The velocity pattern generator 47 creates the velocity patterns to drive the motor M1 and the motor M3 based on the above-described conditions. In the example shown in FIG. 6, approximately 4.0 to 5.0 seconds after the output of a velocity pattern is finished, the velocity pattern created next starts to be output and this cycle is repeated.

The fabric feed controller 45 outputs a pulse signal as a position command to a servo driver (B) which controls the driving of the motor M3 based on the velocity pattern for the motor M3 created by the velocity pattern generator 47. In this preferred embodiment, the fabric feed controller 45 stores the velocity pattern for the motor M3 created by the velocity pattern generator 47 in a built-in memory (not shown), and a feed operation command signal is input to the velocity pattern generator 47 from the print operation controller 41. When a preset period (set period t1 in FIG. 6) elapses after the input of the feed operation command signal, the fabric feed controller 45 outputs the pulse signal as the position command to the servo driver (B) based on the velocity pattern for the motor M3. The set period t1 is stored in the memory 41*a* as a set value that specifies the time to start driving the motor M3 after the input of the feed operation command signal.

The servo driver (B) controls the driving of the motor M3 based on the position command from the fabric feed controller 45 and a signal from an encoder EN which detects the rotation amount of the motor M3. As a result, the motor M3 is driven to be rotated in accordance with the velocity pattern for the motor M3. FIG. 7*b* shows the moving distance of the fabric material CL realized by the rotation of the feed roll 5 when the motor M3 is driven in accordance with the velocity pattern.

The fabric feed controller 45 outputs a drive completion signal indicating that the rotation of the motor M3 (in other words, the first feed operation on the fabric material CL) is completed to the print operation controller 41. In this preferred embodiment, the drive completion signal is output when a preset period (t2 in FIG. 6) elapses after the position command starts to be output (in other words, after the motor M3 starts to be driven). The set period t2 is longer than the set operation period of the motor M3. The set period t2 includes an extra period added to the set operation period of the motor M3.

In this preferred embodiment, the drive completion signal is output after an elapse of a set period which is set based on the set operation period of the motor M3. The time to output the drive completion signal is not limited to this. For example, the drive completion signal may be output when the condition is fulfilled that the tensile force of the fabric material CL is stable, namely, when the condition is fulfilled that the tensile force of the fabric material CL detected by the tensile force detection device is within a prescribed range from the target tensile force value. In this preferred embodiment, at the time when the rotation of the motor M3 of the set rotation amount is completed, a signal indicating that the rotation of the motor M3 is completed is output from the servo driver (B) to the fabric feed controller 45. This is for the purpose of detecting rotation abnormality or the like of the motor M3. Alternatively, the drive completion signal may be output from the fabric feed controller 45 when the condition is fulfilled that the rotation completion signal is input thereto. Still alternatively, the drive completion signal may be output when at least two conditions, among the conditions regarding the set period t2, the tensile force of the fabric material CL and the rotation completion signal of the motor M3, are fulfilled.

A basic operation of the feed controller 44 is to output a pulse signal as a position command to a servo driver (A) which controls the driving of the motor M1 based on the velocity pattern for the motor M1 created by the velocity pattern generator 47.

The feed controller 44 includes a drive indicator 44*c*. The drive indicator 44*c* includes a built-in memory (not shown) and stores, in the memory 44*c*, the velocity pattern for the motor M1 created by the velocity pattern generator 47. The feed controller 44 outputs the pulse signal as the position command to the servo driver (A) based on the velocity pattern for the motor M1. The servo driver (A) controls the driving of the motor M1 based on the position command from the feed controller 44 and a signal from the encoder EN which detects the rotation amount of the motor M1. As a result, the motor M1 is driven to be rotated in accordance with the velocity pattern for the motor M1.

The feed controller 44 includes a tensile force detector 44*a* and a comparator 44*b*, in addition to the drive indicator 44*c*, in order to control the driving of the motor M1 in accordance with the tensile force of the fabric material CL. The tensile force detector 44*a* is coupled to the load cell 31. The comparator 44*b* is connected to the tensile force detector 44*a* and also to the drive indicator 44*c*. A load cell amplifier 48 is provided between the tensile force detector 44*a* and the load cell 31. The load cell amplifier 48 outputs a tensile force signal (T), in accordance with the load detection signal output from the load cell 31, to the tensile force detector 44*a*.

A feed operation command signal is input to the tensile force detector 44*a* from the print operation controller 41. The tensile force detector 44*a* samples the tensile force signal (T) from the load cell amplifier 48 as a detected value of the tensile force of the fabric material CL for each preset detection period, and stores such tensile force signals sequentially. At the time when the feed operation command signal is input to the tensile force detector 44*a*, the tensile force detector 44*a* calculates an average value of the plurality of detected values in a prescribed period which ends at the time of input. The tensile force detector 44*a* outputs the calculated average value to the comparator 44*b* as an average tensile force value (Ta). The average tensile force value (Ta) is an example of a "detected tensile force value based on the detected value of the tensile force".

The comparator 44*b* has the set value of the target tensile force of the fabric material CL output from the print operation controller 41 (target tensile force value (T0)) stored in a built-in memory (not shown). At the time when the average tensile force value (Ta) is input from the tensile force detector 44*a*, the comparator 44*b* calculates a deviation between the average tensile force value (Ta) and the target tensile force value (T0), and outputs a deviation signal (δ), including a magnitude and a direction (positive or negative) of the deviation, to the drive indicator 44*c*. The deviation signal (δ) may indicate a positive value, a negative value or zero.

At the time when the deviation signal (δ) is input from the comparator 44*b*, the drive indicator 44*c* corrects the velocity pattern based on the deviation signal (δ). Based on the corrected velocity pattern, the drive indicator 44*c* starts outputting the position command. In the case where the deviation signal (δ) indicates zero, the position command is output with no correction on the velocity pattern created by the velocity pattern generator 47. The position command is started to be output when the set period t1 elapses after the input of the feed operation command signal. Namely, in this preferred embodiment, as described above, the motor M1 starts to be driven at the same time as the start of rotation of the feed roll 5 (in other words, at the same time as the start of driving of the motor M3). Therefore, the set period t1 stored in the memory 41*a* is used as the set period to specify the time to start driving the motor M1 after the input of the feed operation command signal, like in the case of the fabric feed controller 45.

Figure 8:
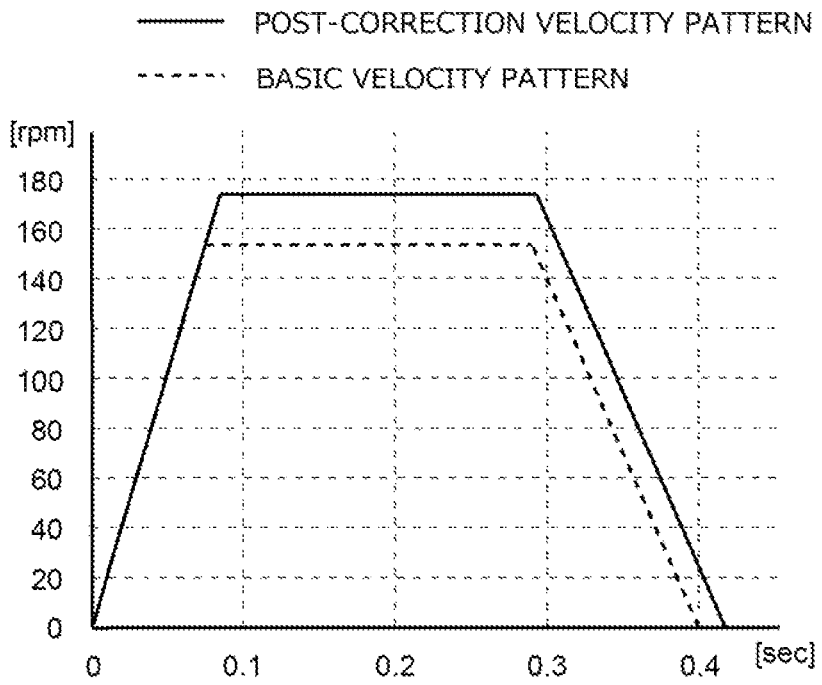
FIG. 8 is a graph showing a post-correction velocity pattern realized by a drive indicator and a basic velocity pattern.

FIG. 8 shows an example of post-correction velocity pattern. In the example shown in FIG. 8, the average tensile force value (Ta) is higher than the target tensile force value (T0); in other words, the deviation has a positive value. Namely, the tensile force of the fabric material CL is higher than the desired value as a result of the feed operation performed on the fabric material CL. In FIG. 8, the basic velocity pattern represented with the dashed line is created by the velocity pattern generator 47 based on the set values stored in the memory 41*a* of the print operation controller 41.

In the example shown in FIG. 8, the tensile force of the fabric material CL is high. Therefore, the drive indicator 44*c* corrects the velocity pattern such that the rotation amount of the motor M1 is increased by the magnitude corresponding to the deviation, in order to decrease the tensile force. Namely, the drive indicator 44*c* corrects the velocity pattern so as to increase the length of the fabric material CL to be fed. In the case where the average tensile force value (Ta) is lower than the target tensile force value (T0) (namely, in the case where the deviation has a negative value), the velocity pattern is corrected such that the rotation amount of the motor M1 is decreased. Namely, the velocity pattern is corrected so as to decrease the length of the fabric material CL to be fed.

In the example shown in FIG. 8, neither the acceleration nor the deceleration is changed. Namely, in the post-correction velocity pattern, like in the basic velocity pattern, the acceleration is kept constant throughout the acceleration period, and the deceleration is kept constant throughout the deceleration period. The acceleration and the deceleration correspond to the set values stored in the memory 41*a* of the print operation controller 41.

In the example shown in FIG. 8, the operation period is changed from that of the basic velocity pattern in consideration of the increase of the rotation rate of the motor M1. In this preferred embodiment, the drive indicator 44*c* does not change the acceleration or the deceleration when correcting the velocity pattern. In addition, an upper limit is set on the rotation rate of the motor M1, and the velocity pattern is corrected such that the rotation rate does not exceed the upper limit. This is why the drive indicator 44*c* changes the operation period to increase the rotation amount of the motor M1 based on the deviation.

In order to increase the rotation amount, it is not absolutely necessary to change the operation period or to change the acceleration or the deceleration. The rotation amount can be increased by increasing the rotation rate during the constant velocity drive period (namely, the maximum rotation rate while the motor is driven). When the rotation amount during the constant velocity drive period is increased, the constant velocity drive period is shortened in order to increase the rotation amount without changing the operation period. However, when the maximum rotation rate is high, the load applied on the motor M1 at the time of transfer from the acceleration state to the constant velocity state and at the time of transfer from the constant velocity state to the deceleration state could be high. In order to avoid this, it is considered to set the upper limit on the rotation rate of the motor M1. In this case, when the rotation rate exceeds the upper limit, the operation period is changed while the rotation amount corrected based on the deviation is fulfilled. When the post-correction rotation amount is fulfilled and the rotation rate does not exceed the upper limit, only the constant velocity drive period is changed and the operation period is not changed.

In the case where the load applied on the motor M1 does not need to be considered, the velocity pattern may be corrected only by changing the constant velocity drive period without the upper limit being set on the rotation rate. In this case, when the rotation amount in accordance with the deviation is not obtained even though the constant velocity drive period is set to 0, namely, the velocity pattern includes only the acceleration period and the deceleration period and thus is represented with a triangle, the operation period is also changed.

In this preferred embodiment, a combination of the memory 41*a* of the print operation controller 41, the feed controller 44 and the fabric feed controller 45 of the drive controller 43, and the two servo drivers (A) and (B) corresponds to a "drive control device". The servo driver (A) corresponds to a "feed control device". The "tensile force detection device" includes the support roll 4, the load cell 31, the load cell amplifier 48 and the tensile force detector 44*a* of the drive controller 43.

The winding controller 46 outputs a torque command in accordance with the winding diameter of the winding roll 7 to a torque controller 49. The torque controller 49 controls the driving of the motor M2, which is a torque motor. The winding diameter sensor 7*s* which detects the diameter of the winding roll 7 outputs an electric signal corresponding to the detected winding diameter (winding signal (D)) to the winding controller 46. The winding controller 46 corrects the set torque stored in the memory 41*a* of the print operation controller 41 by use of the winding signal (D) and outputs a torque command signal in accordance with the post-correction torque to the torque controller 49. Based on the torque command signal from the winding controller 46, the torque controller 49 controls the motor M2 such that the motor M2 is driven at the post-correction torque.

As described above, in the printing device in this preferred embodiment, the feed roll 5 provided downstream with respect to the print unit 8 is driven by a prescribed rotation amount intermittently by the motor M3. As a result, the fabric material CL in the print unit 8 is pulled downstream by the feed roll 5. Thus, the feed operation on the fabric material CL is performed in the print unit 8. More specifically, the fabric material CL is fed downstream by a prescribed length. Along with the feed operation on the fabric material CL, the fabric material CL is actively fed toward the print unit 8 also in the supply/feed portion upstream with respect to the support roll 4. The serving roll 3 having the fabric material CL wound therearound is driven to be rotated, and thus the fabric material CL is actively fed toward the print unit 8. As a result, the tensile force of the fabric material CL is prevented from changing due to the feed roll 5 puling the fabric material CL.

In addition, in the printing device in this preferred embodiment, the tensile force of the fabric material CL is detected via the support roll 4 which guides the fabric material CL at a position upstream with respect to the print unit 8. The set rotation amount which is preset in accordance with the rotation amount of the feed roll 5 is corrected based on the detected tensile force. The post-correction rotation amount is the driving amount of the serving roll 3 (in other words, the rotation amount of the serving roll 3). As a result, the length of the fabric material CL to be fed by the serving roll 3 is adjusted in accordance with the detected tensile force of the fabric material CL. Therefore, the effect of significantly reducing the tensile force is made large.

In the printing device in this preferred embodiment, the fabric material CL pulled from the supply roll 1 is not pinched by a pair of rolls at any point on the moving route between the supply roll 1 and the winding roll 7. In a structure of pinching the fabric material CL by a pair of rolls while feeding the fabric material CL, a quality problem may occur such that, for example, a trace of pressure is left on the fabric material CL depending on the properties of the fabric material CL or the force of the pair of rolls for pinching the fabric material CL. By contrast, in this preferred embodiment, the fabric material CL is not pinched by such rolls, and therefore the quality problem as described above does not occur.

In addition, in the printing device in this preferred embodiment, the acceleration of the serving roll 3 is set to be larger than the acceleration of the feed roll 5 during the feed operation on the fabric material CL. There are cases where the active feed of the fabric material CL by the serving roll 3 does not directly lead to the feed of the fabric material CL in the print unit 8 due to the inertia of the support roll 4, the frictional resistance between the support roll 4 and the fabric material CL or the like. Even in such cases, as long as the length of the fabric material CL to be fed by the serving roll 3 is set to be longer than the length of the fabric material CL to be fed by the feed roll 5 in an initial period of the feed operation, the tensile force of the fabric material CL is prevented from being significantly increased in the initial period.

Figure 9:
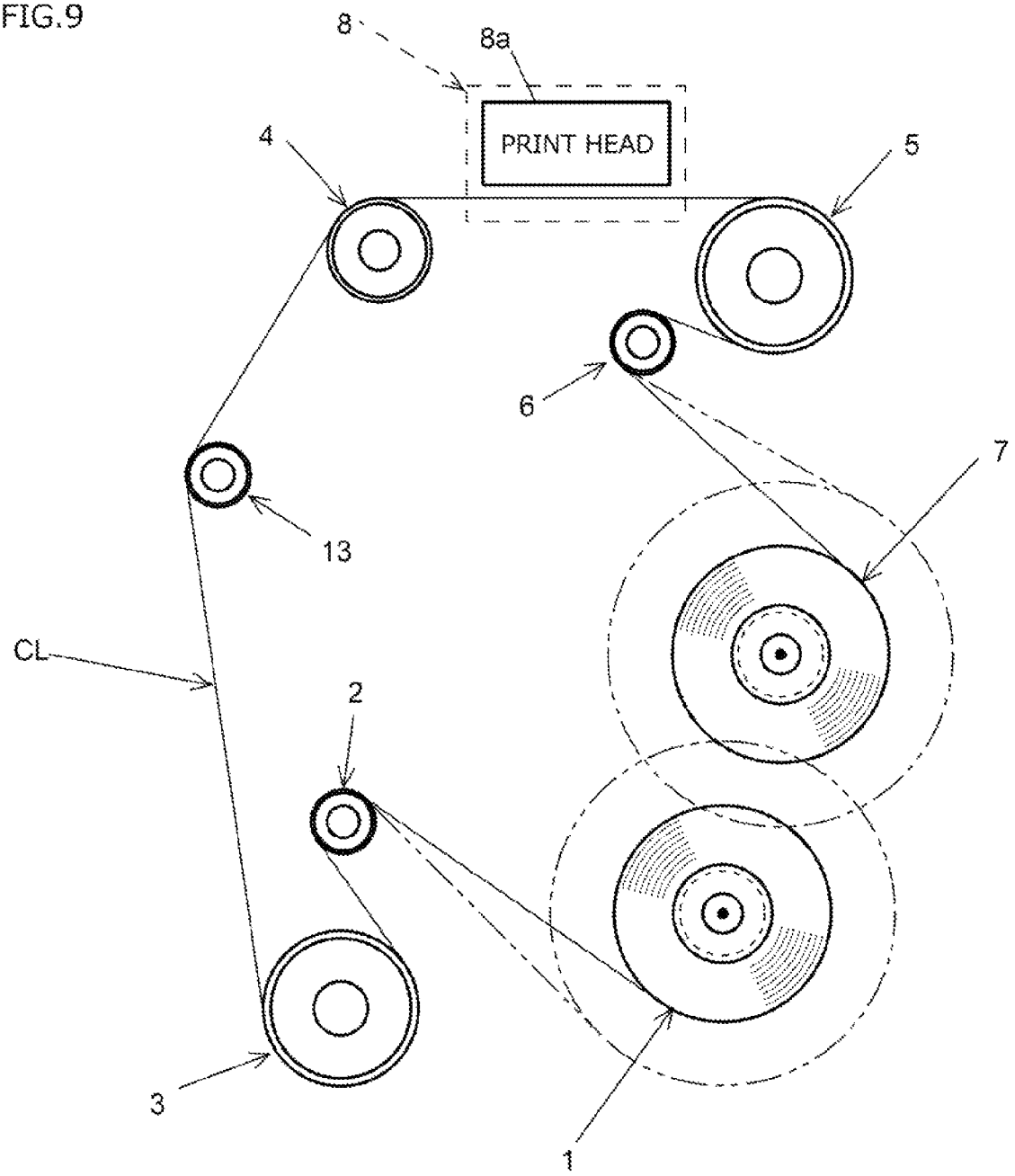
FIG. 9 is a structural view of a printing device according to another preferred embodiment of the present invention.

The printing method and the printing device according to the present invention are not limited to the above-described preferred embodiments, but may be appropriately modified without departing from the gist of the present invention. For example, the locations of the supply roll 1, the winding roll 7 and the like are not limited to those in the above-described preferred embodiments, and may be appropriately modified in consideration of the size or the like of the printing device. As an example. the structure shown in FIG. 9 may be used. In the structure shown in FIG. 9, the supply roll 1 and the winding roll 7 are located on the same side as the print unit 8 in the front-rear direction. Namely, the supply roll 1 and the winding roll 7 are located on the front side. According to the structure shown in FIG. 9, the size of the entire printing device in the front-rear direction is smaller than that of the printing device described above.

In the above-described preferred embodiment, the serving roll 3 driven by the motor M1 preferably is located downstream with respect to the supply roll 1, and the fabric material CL is fed toward the print unit 8 by the serving roll 3. Alternatively, the supply roll 1 may be driven by the motor M1 and feed the fabric material CL. In this case, the serving roll 3 and the feed-side guide roll 2 provided in the above-described preferred embodiment are omitted. In this case, the supply roll 1 acts as the "supply/feed roll".

In the above-described preferred embodiment, the tensile force detection device preferably is structured to detect the tensile force of the fabric material CL via the support roll 4. The support roll 4 is structured to change the moving direction of the fabric material CL, fed from the serving roll 3 located below the support roll 4 so that the fabric material CL is directed toward the print unit 8. In the structure shown in FIG. 9, a guide roll 13 which guides the fabric material CL is provided between the support roll 4 and the serving roll 3. In this structure, the tensile force detection device may be structured to detect the tensile force via the guide roll 13.

In the above-described preferred embodiments, the load detector (load cell) 31 which detects the load in accordance with the tensile force of the fabric material CL preferably is connected to one of the two ends of the support roll 4. Alternatively, the load detector 31 may be connected to each of two ends of the roll acting as a part of the tensile force detector 44*a* (support roll 4 or guide roll 13 shown in FIG. 9), so that the tensile force of the fabric material CL is detected based on the detection values of the load detectors 31.

In the above-described preferred embodiments, the fabric material CL preferably is wound around the serving roll 3 having the slip-proof member 3*c* attached to the outer circumferential surface thereof, and the serving roll 3 is driven to feed the fabric material CL toward the print unit 8. Alternatively, the printing device may include the supply/feed roll which is rotatable by being driven and a driven roll which is pressed to the supply/feed roll and is rotated by the rotation of the supply/feed roll, so that the fabric material CL is fed while being pinched by these rolls. In this structure, a change in the winding angle of the fabric material CL to the supply/feed roll (serving roll 3) does not influence the length of the fabric material CL to be fed. Therefore, the feed-side guide roll 2 provided in the above-described preferred embodiment can be omitted. Also in this structure, the fabric material CL does not need to be wound around the supply/feed roll (serving roll 3) unlike in the above-described preferred embodiment. The supply/feed roll and the driven roll may be provided on a straight route of the fabric material CL.

In the above-described preferred embodiment, the feed roll 5 is structured to pull the fabric material CL at a position downstream with respect to the print unit 8. In such a structure in which the fabric material CL is pulled at a position downstream with respect to the print unit 8 in order to perform the feed operation on the fabric material CL, a portion of the elements contacts the fabric material CL already having printing performed thereon. For this reason, a roll such as the feed roll 5 or the like that contacts only a non-printed surface of the fabric material CL to pull the fabric material CL is preferable to a roll which contacts the printed surface of the fabric material CL to pull the fabric material CL. However, in the case where the printed surface of the fabric material CL is sufficiently dry, even when the fabric material CL is pulled while being pinched by a pair of rolls, the effect on the printed surface is small. Therefore, when the printing device includes a dryer or the like, the feed roll 5 may be replaced with a pair of rolls which pull the fabric material CL while pinching the fabric material CL already having printing performed thereon.

In the above-described preferred embodiments, the velocity pattern to drive each of the motor M1 and the motor M3 is set such that the acceleration during the acceleration period and the deceleration during the deceleration period are kept constant. The velocity pattern to drive each of the motor M1 and the motor M3 are not limited to such a pattern. For example, the velocity pattern may be appropriately modified in consideration of the load or the like applied on each motor, such that the acceleration and the deceleration are decreased in an initial period and/or an end period of the acceleration period and the deceleration period.

In the above-described preferred embodiments, the acceleration during the acceleration period preferably is uniform acceleration. In addition, the acceleration of the motor M1 in the acceleration period is set to be larger than the acceleration of the motor M3 in the acceleration period, in order to prevent the tensile force of the fabric material CL from being increased in the initial period of the feed operation. Alternatively, for example, the acceleration of the motor M1 may be set to be larger only in the initial period of the feed operation. For example, the velocity pattern to drive the motor M1 may be set such that the acceleration in a first half of the acceleration period is larger than the acceleration of the motor M3 and the acceleration in a second half of the acceleration period is equal to the acceleration of the motor M3.

In the above-described preferred embodiments, the structure that prevents the tensile force of the fabric material CL from being increased in the initial period of the feed operation is not limited to the above-described structure in which the acceleration of the motor M1 and the acceleration of the motor M3 are made different. The acceleration of the motor M1 and the acceleration of the motor M3 may be set to be equal to each other and the time to start driving the motor M1 may be set to be prior to the time to start driving the motor M3. As described above, the set period stored in the memory 41*a* (set period t1 in FIG. 6 in the above-described preferred embodiments) is set to specify the time to start driving the motor M1 and the motor M3. The time to start driving the motor M1 and the motor M3 is measured from the time when the feed operation command signal from the print operation controller 41 is input. For example, different periods may be set for the motor M1 and the motor M3. The set period for the motor M1 may be shorter than the set period for the motor M3. In this case also, substantially the same effect as that in the above-described preferred embodiments is provided. Both of the acceleration and the set period may be different for the motor M1 and for the motor M3.

In the above-described preferred embodiments, neither the acceleration and nor the deceleration is changed to correct the velocity pattern for the motor M1. Alternatively, the acceleration or the deceleration may be changed so that the operation period is not changed.

In the above-described preferred embodiments, the memory 41*a* is preferably included in the print operation controller 41. Alternatively, the memory 41*a* may be included in the drive controller 43. In this case, the input setter 42 is also connected to the memory 41*a* of the drive controller 43.

The velocity pattern generator 47 included in the drive controller 43 is not limited to being common to the feed controller 44 and the fabric feed controller 45 as in the above-described preferred embodiment. The velocity pattern generator 47 may be provided for each of the feed controller 44 and the fabric feed controller 45. In the above-described preferred embodiments, the created velocity pattern is corrected by the feed controller 44. Alternatively, the velocity pattern generator 47 may be provided between the comparator 44*b* and the drive indicator 44*c* and correct the created velocity pattern.

In the above-described preferred embodiments, an average value of the plurality of detected tensile force values (average tensile force value (Ta)) in the prescribed period which ends at the time when the feed operation command signal is input preferably is used as a detected tensile force value to be compared by the comparator 44*b*. Alternatively, the tensile force value detected at the time when the feed operation command signal is input may be used as the detected tensile force value to be compared by the comparator 44*b*.

In the above-described preferred embodiments, the detected tensile force value (average tensile force value (Ta)) and the target tensile force value (T0) are compared and a deviation signal based on the comparison is output immediately before the motor M1 starts to be driven along with the feed operation (in other words, at the time when the feed operation command signal is output from the print operation controller 41). The velocity pattern to drive the serving roll 3 is corrected based on the deviation signal. Alternatively, the comparison and the output of the deviation signal may be performed at any time when the feed operation is not performed. Based on the deviation signal, the motor M1 at a pause may be driven to eliminate the deviation. Specifically, this can be performed as follows.

First, the tensile force detector 44*a* detects a tensile force signal (T) from the load cell amplifier 48 as a detected value of the tensile force for each preset detection period. Each time the value is detected, the tensile force detector 44*a* outputs the detected value to the comparator 44*b* as a detected tensile force value. The comparator 44*b* compares the detected tensile force value against the target tensile force value each time that the detected tensile force value is input, namely, for each detection period of the tensile force, and outputs a deviation signal to the drive indicator 44*c*.

When the result of the comparison indicates that the detected tensile force value is deviated from the target tensile force value, the drive indicator 44*c* outputs a position command (pulse signal) to drive the motor M1 in a direction to eliminate the deviation. The driving amount of the motor M1 at this point may be an amount calculated in accordance with the magnitude of the deviation or may be a preset amount.

When the actual tensile force of the fabric material CL (detected tensile force value) is different from the target tensile force (target tensile force value), the tensile force of the fabric material CL is adjusted. More specifically, the supply/feed roll is rotated such that the actual tensile force is made closer to the target tensile force. As can be seen, the tensile force of the fabric material CL is adjusted in real time, each time that the tensile force of the fabric material CL is detected, at any time when the feed operation is not performed. As a result, the tensile force of the fabric material CL substantially matches the target tensile force at the time when the fabric material CL starts to be fed. Therefore, in this case, the correction of the basic velocity pattern can be omitted unlike in the above-described preferred embodiments. The supply/feed roll may be driven in accordance with the basic velocity pattern like the feed roll 5. The motor M1 may be driven in accordance with the basic velocity pattern like the motor M3.

Regarding the above-described real-time adjustment on the tensile force of the fabric material CL performed by controlling the driving of the motor M1, when the set detection period is short, the driving of the motor M1 may be controlled each time that the tensile force is detected a prescribed plurality of times, instead of each time that the tensile force is detected once. Namely, the motor M1 may be driven for each prescribed period in which the tensile force is detected at least twice. In this case, the detected tensile force value used for the comparison with the target tensile force value may be an average of the plurality of tensile force values obtained in the prescribed period, or only the latest detected value (namely, the value detected immediately before the motor M1 is driven) may be used for the comparison.

In the above-described preferred embodiments, to drive the motor M1 along with the feed operation on the fabric material CL, the correction of the basic velocity pattern performed in accordance with the deviation between the detected tensile force value and the target tensile force value may be omitted.

Alternatively, the real-time tensile force adjustment performed at any time when the feed operation is not performed may also be performed in the above-described preferred embodiments.

The motor M1 does not need to be driven in accordance with the velocity pattern along with the feed operation on the fabric material CL, unlike in the above-described preferred embodiments. The tensile force adjustment on the fabric material CL may be performed only in real time. Namely, the motor M1 may be driven based only on the detected tensile force value.

The present invention is not limited to the above-described preferred embodiments and other examples, and may be appropriately modified without departing from the gist of the present invention.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A printing method performed by use of a printing device usable for fabrics, the printing device including an inkjet print head that performs printing on a fabric material, a supply roll around which the fabric material is wound, a support roll that winds therearound the fabric material fed from the supply roll and guides the fabric material toward a position below the print head, a winding roll that is driven to rotate to wind therearound the fabric material which has passed the position below the print head, and a feed roll provided on a moving route of the fabric material between the position below the print head and the winding roll and being contactable with the fabric material, wherein the printing device feeds the fabric material toward the winding roll by a prescribed length each time that one cycle of a print operation is performed by the print head so that the printing is performed on the fabric material intermittently, the printing method comprising the steps of:

performing, after one cycle of the print operation, a first feed operation on the fabric material of intermittently rotating the feed roll by a first motor to pull the fabric material from the position below the print head and feed the fabric material toward the winding roll by a prescribed length by the rotation of the feed roll;

performing, along with the first feed operation, a second feed operation on the fabric material of intermittingly rotating a supply-side feed roller or the supply roll by a second motor to feed the fabric material toward the position below the print head, the supply-side feed roller being contactable with the fabric material at a position upstream with respect to the support roll in a moving direction of the fabric material;

detecting a tensile force of the fabric material at a position upstream with respect to the position below the print head in the moving direction of the fabric material;

comparing a detected tensile force value based on the detected value of the tensile force of the fabric material to a preset target tensile force value; and controlling the second motor based on a result of the step of comparing.

2. A printing method according to claim 1, wherein if there is a deviation between the detected tensile force value and the target tensile force value, a driving amount of the second motor is corrected based on the deviation, and the second motor is controlled in accordance with the corrected driving amount.

3. A printing method according to claim 1, wherein:

the tensile force of the fabric material is detected at each prescribed detection cycle;

the detected tensile force value is compared to the target tensile force value each time the tensile force is detected or for each prescribed period in which the detection is performed at least twice; and if there is a deviation between the detected tensile force value and the target tensile force value, the second motor is controlled so as to eliminate the deviation.

4. A printing method performed by use of a printing device usable for fabrics, the printing device including a print head that performs printing on a fabric material, a supply roll around which the fabric material is wound, a support roll that winds therearound the fabric material fed from the supply roll and guides the fabric material toward a position below the print head, a winding roll that is driven to rotate to wind therearound the fabric material which has passed the position below the print head, and a feed roll provided on a moving route of the fabric material between the position below the print head and the winding roll and being contactable with the fabric material, wherein the printing device feeds the fabric material toward the winding roll by a prescribed length each time that one cycle of a print operation is performed by the print head so that the printing is performed on the fabric material intermittently, the printing method comprising the steps of:

performing, after one cycle of the print operation, a first feed operation on the fabric material of intermittently rotating the feed roll by a first motor to pull the fabric material from the position below the print head and feed the fabric material toward the winding roll by a prescribed length by the rotation of the feed roll;

performing, along with the first feed operation, a second feed operation on the fabric material of intermittingly rotating a supply-side feed roller or the supply roll by a second motor to feed the fabric material toward the position below the print head, the supply-side feed roller being contactable with the fabric material at a position upstream with respect to the support roll in a moving direction of the fabric material;

detecting a tensile force of the fabric material at a position upstream with respect to the position below the print head in the moving direction of the fabric material;

comparing a detected tensile force value based on the detected value of the tensile force of the fabric material to a preset target tensile force value; and controlling the second motor based on a result of the step of comparing; wherein in at least an initial period of the first feed operation, an acceleration to drive the second motor is set to be larger than an acceleration to drive the first motor.

5. A printing method according to claim 1, wherein a time to start driving the second motor is set to be prior to a time to start driving the first motor.

6. A printing device usable for fabrics, comprising:

an inkjet print head that performs printing on a fabric material;

a supply roll around which the fabric material is wound;

a support roll that winds therearound the fabric material fed from the supply roll and guides the fabric material toward a position below the print head; and a winding roll that is driven to rotate to wind therearound the fabric material which has passed the position below the print head; wherein the printing device feeds the fabric material toward the winding roll by a prescribed length each time that one cycle of a print operation is performed by the print head so that the printing is performed on the fabric material intermittently;

the printing device further comprises:

a feed roll provided on a moving route of the fabric material between the position below the print head and the winding roll and being contactable with the fabric material;

a first motor that rotates the feed roll;

a supply-side feed roller acting as the supply roll, or a supply-side feed roller different from the supply roll and contactable with the fabric material at a position upstream with respect to the support roll in the moving direction of the fabric material;

a second motor that rotates the supply-side feed roller;

a drive control device that is programmed to perform a first feed operation to control the first motor so as to intermittently rotate the feed roll and pull the fabric material from the position below the print head and feed the fabric material toward the winding roll by a prescribed length, and a second feed operation to control the second motor so as to intermittingly rotate the supply-side feed roller along with the first feed operation and feed the fabric material toward the position below the print head; and a tensile force detection device that detects a tensile force of the fabric material at a position upstream with respect to the position below the print head in the moving direction of the fabric material; wherein the drive control device includes:

a memory that stores a target tensile force value of the fabric material;

a comparator that compares a detected tensile force value, based on the detected value of the tensile force that is detected by the tensile force detection device, to the target tensile force value stored in the memory and outputs a deviation signal;

a drive indicator that receives the deviation signal from the comparator and outputs a drive command signal corresponding to a driving amount of the second motor; and a feed control device that is programmed to control the second motor in accordance with the drive command signal from the drive indicator.

7. A printing device usable for fabrics according to claim 6, wherein:

the comparator is structured to output the deviation signal including a magnitude and a direction of deviation between the detected tensile force value and the target tensile force value; and the drive indicator is structured to, if there is a deviation between the detected tensile force value and the target tensile force value, correct the driving amount of the second motor based on the deviation and output the drive command signal in accordance with the corrected driving amount.

8. A printing device usable for fabrics according to claim 6, wherein:

the tensile force detection device is structured to detect the tensile force of the fabric material for each prescribed detection period;

the comparator is structured to compare the detected tensile force value against the target tensile force value and output the deviation signal each time the tensile force is detected by the tensile force detection device or for each prescribed period in which the detection is performed at least twice; and the drive indicator is structured to, if the deviation signal indicates that there is a deviation between the detected tensile force value and the target tensile force value, output the drive command signal corresponding to a driving amount to eliminate the deviation.

9. A printing device usable for fabrics according to claim 6, wherein:

the memory stores an acceleration value to drive the first motor and an acceleration value to drive the second motor; and in at least an initial period of the second feed operation, the acceleration value to drive the second motor is larger than the acceleration value to drive the first motor.

10. A printing device usable for fabrics according to claim 6, wherein:

the memory stores a set value that specifies a time to start driving the first motor and a time to start driving the second motor; and the set value is set such that the time to start driving the second motor is prior to the time to start driving the first motor.

* * * * *